US007433636B2

(12) United States Patent
Teschendorf et al.

(10) Patent No.: US 7,433,636 B2
(45) Date of Patent: Oct. 7, 2008

(54) METHOD AND APPARATUS FOR USING A TRANSFER ASSIST LAYER IN A TANDEM ELECTROPHOTOGRAPHIC PROCESS WITH ELECTROSTATICALLY ASSISTED TONER TRANSFER

(75) Inventors: Brian P. Teschendorf, Vadnais Heights, MN (US); Hsin Hsin Chou, Woodbury, MN (US); Charles W. Simpson, Lakeland, MN (US); Manuel Lozada, New Brighton, MN (US); Truman F. Kellie, Lakeland, MN (US); James A. Baker, Hudson, WI (US)

(73) Assignee: Samsung Electronics Co., Ltd., Suwon (KR)

( * ) Notice: Subject to any disclaimer, the term of this patent is extended or adjusted under 35 U.S.C. 154(b) by 429 days.

(21) Appl. No.: 10/884,688

(22) Filed: Jun. 30, 2004

(65) Prior Publication Data

US 2005/0141928 A1 Jun. 30, 2005

Related U.S. Application Data

(60) Provisional application No. 60/533,717, filed on Dec. 31, 2003.

(51) Int. Cl.
*G03G 15/16* (2006.01)
*G03G 15/01* (2006.01)

(52) U.S. Cl. ..... 399/296; 399/233; 399/302

(58) Field of Classification Search ..... 399/296, 399/302, 308, 233
See application file for complete search history.

(56) References Cited

U.S. PATENT DOCUMENTS

| | | | |
|---|---|---|---|
| 3,157,546 | A | 11/1964 | Cover |
| 3,411,936 | A | 11/1968 | Roteman et al. |
| 3,716,360 | A | 2/1973 | Fukushima et al. |
| 3,808,026 | A | 4/1974 | Sato et al. |
| 3,893,761 | A | 7/1975 | Buchan et al. |
| 4,337,303 | A | 6/1982 | Sahyun et al. |
| 4,413,048 | A | 11/1983 | Landa |
| 4,420,244 | A | 12/1983 | Landa |

(Continued)

FOREIGN PATENT DOCUMENTS

| | | | |
|---|---|---|---|
| EP | 0410800 B1 | | 1/1991 |
| JP | 2000267448 A | * | 9/2000 |

OTHER PUBLICATIONS

Schmidt, S.P. and Larson, J.R., in Handbook of Imaging Materials Diamond, A.S., Ed: Marcel Dekker: New York; Ch. 6, pp. 227-252.

*Primary Examiner*—Susan S Lee
(74) *Attorney, Agent, or Firm*—DLA Piper US LLP

(57) ABSTRACT

A method of producing an image on a final image receptor in a single pass electrophotographic system is provided. The method includes the steps of providing at least one toner development unit including a photoreceptive element and charged toner particles, and creating a toned image on the photoreceptive element that is transferred to an intermediate transfer member. The method further includes providing a transfer assist material development unit for applying a transfer assist material to at least a portion of the toned image to form a complete image layer on the intermediate transfer member, wherein the complete image layer is formed in a single pass of the intermediate transfer member. The method also includes contacting the complete image layer with a final image receptor while applying a bias that is sufficiently strong to transfer at least a portion of the complete image layer to the final image receptor.

59 Claims, 10 Drawing Sheets

U.S. PATENT DOCUMENTS 4,886,726 A 12/1989 Chan et al.
5,037,718 A 8/1991 Light et al.
5,102,767 A * 4/1992 Chowdry et al.
5,176,974 A 1/1993 Till et al.
5,215,852 A 6/1993 Kato et al.
5,370,960 A 12/1994 Cahill et al.
5,383,008 A 1/1995 Sheridon
5,391,445 A 2/1995 Kato et al.
5,395,721 A 3/1995 Kato et al.
5,420,676 A 5/1995 Arcaro
5,432,591 A 7/1995 Geleynse
5,521,271 A 5/1996 Smith et al.
5,541,029 A * 7/1996 Iwata et al.
5,582,941 A 12/1996 Kato et al.
5,589,308 A 12/1996 Kato et al.
5,604,070 A 2/1997 Rao et al.
5,620,822 A 4/1997 Kato et al.
5,626,996 A 5/1997 Kato et al.
5,648,190 A 7/1997 Kato et al.
5,650,253 A 7/1997 Baker et al.
5,689,785 A 11/1997 Kato et al.
5,733,698 A 3/1998 Lehman et al.
5,744,269 A 4/1998 Bhattacharya et al.
5,747,214 A 5/1998 Kato et al.
5,916,718 A 6/1999 Kellie et al.
5,919,866 A 7/1999 Rao et al.
5,926,679 A * 7/1999 May et al. ..... 399/296
6,045,956 A 4/2000 Kato et al.
6,047,143 A * 4/2000 Larson et al.
6,255,363 B1 * 7/2001 Baker et al.
6,314,253 B1 * 11/2001 Hosoya et al. ..... 399/296
6,674,984 B2 * 1/2004 Oooka ..... 399/308
6,996,360 B2 * 2/2006 Koga et al. ..... 399/296
2002/0114637 A1 8/2002 Park et al.
2004/0091808 A1 5/2004 Qian et al.
2004/0091809 A1 5/2004 Qian et al.

* cited by examiner

METHOD AND APPARATUS FOR USING A TRANSFER ASSIST LAYER IN A TANDEM ELECTROPHOTOGRAPHIC PROCESS WITH ELECTROSTATICALLY ASSISTED TONER TRANSFER

REFERENCE TO RELATED APPLICATIONS

This application claims the benefit of U.S. Provisional application Ser. No. 60/533,717, filed Dec. 31, 2003, entitled "METHOD AND APPARATUS FOR USING A TRANSFER ASSIST LAYER IN A TANDEM ELECTROPHOTOGRAPHIC PROCESS WITH ELECTROSTATICALLY ASSISTED TONER TRANSFER," which application is incorporated herein by reference in its entirety.

Each of the following copending U.S. patent applications of the present Assignee are incorporated herein by reference in its respective entirety:

U.S. Ser. No. 10/884,687, filed on even date herewith, entitled "METHOD AND APPARATUS FOR USING A TRANSFER ASSIST LAYER IN A MULTI-PASS ELECTROPHOTOGRAPHIC PROCESS WITH ELECTROSTATICALLY ASSISTED TONER TRANSFER,"

U.S. Ser. No. 10/884,702, filed on even date herewith, entitled "METHOD AND APPARATUS FOR USING A TRANSFER ASSIST LAYER IN A TANDEM ELECTROPHOTOGRAPHIC PROCESS UTILIZING ELASTOMERIC TONER TRANSFER," and U.S. Ser. No. 10/884,339, filed on even date herewith, entitled "METHOD AND APPARATUS FOR USING A TRANSFER ASSIST LAYER IN A TANDEM ELECTROPHOTOGRAPHIC PROCESS UTILIZING ADHESIVE TONER TRANSFER."

TECHNICAL FIELD

The present invention relates to methods and systems to assist toner transfer for use with electrophotographic processes, and particularly relates to the use of such methods and systems with liquid toner materials.

BACKGROUND OF THE INVENTION

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not re-useable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974.

In contrast, electrophotographic imaging processes typically involve the use of a reusable, radiation sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which may also be referred to as "light" or actinic radiation, may include infrared radiation, visible light, and ultraviolet radiation, for example.

In the development step, toner particles of the appropriate polarity are generally brought into contact with the latent image on the photoreceptor, typically using an electrically-biased development roller to bring the charged toner particles into close proximity to the photoreceptive element. The polarity of the development roller should be the same as that of the particles and the electrostatic bias potential on the development roller should be higher than the potential of the imagewise discharged surface of the photoreceptor so that the toner particles migrate to the photoreceptor and selectively develop the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The transfer of an image typically occurs by one of the following two methods: elastomeric assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative surface energies between the ink, a photoreceptor surface and a temporary carrier surface or medium for the toner. The effectiveness of such elastomeric assist or adhesive transfer is controlled by several variables including surface energy, temperature, force, and toner rheology. An exemplary elastomeric assist/adhesive image transfer process is described in U.S. Pat. No. 5,916,718.

Electrostatic assist or electrostatic transfer refers generally to a process in which transfer of an image is primarily affected by electrostatic charges or charge differential phenomena between the receptor surface and the temporary carrier surface or medium for the toner. Electrostatic transfer may be influenced by surface energy, temperature, and force, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high force with or without heat. In the cleaning step, any residual toner remaining on the photoreceptor after the transfer step is removed. Finally, in the erasing step, the photoreceptor charge is reduced to a substantially uniformly low value by exposure to radiation of a particular wavelength band, thereby removing remnants of the original latent image and preparing the photoreceptor for the next imaging cycle.

Electrophotographic imaging processes may also be distinguished as being either multi-color or monochrome printing processes. Multi-color printing processes are commonly used for printing graphic art or photographic images, while monochrome printing is used primarily for printing text. Some multi-color electrophotographic printing processes use a multi-pass process to apply multiple colors as needed on the photoreceptor to create the composite image that will be transferred to the final image receptor, either by via an intermediate transfer member or directly. One example of such a process is described in U.S. Pat. No. 5,432,591.

In one exemplary electrophotographic, multi-color, multi-pass printing process, the photoreceptor takes the form of a relatively large diameter drum to permit an arrangement of two or more multi-color development units around the circumference perimeter of the photoreceptor. Alternatively, toners of varying colors can be contained in developing units that are arranged on a moveable sled such that they can be individually moved into place adjacent to the photoreceptor as needed to develop a latent electrophotographic image. A single rotation of the photoreceptor drum generally corresponds to the development of a single color; four drum rotations and four sled movements are therefore required to develop a four color (e.g. full color) image. The multi-color image is generally built up on the photoreceptor in an overlaid configuration, and then the full color image is transferred with each color remaining in imagewise registration, to a final image receptor, either directly or via an intermediate transfer element.

In an exemplary electrophotographic, four-color, four-pass full color printing process, the steps of photoreceptor charging, exposure, and development are generally performed with each revolution of the photoreceptor drum, while the steps of transfer, fusing, cleaning, and erasure are generally performed once every four revolutions of the photoreceptor. However, multi-color, multi-pass imaging processes are known in which each color plane is transferred from the photoreceptor to an intermediate transfer element on each revolution of the photoreceptor. In these processes, the transfer, cleaning and erasure steps are generally performed upon each revolution of the photoreceptor, and the full-color image is built up on the intermediate transfer element and subsequently transferred from the intermediate transfer element to the final image receptor and fused.

Alternatively, electrophotographic imaging processes may be purely monochromatic. In these systems, there is typically only one pass per page because there is no need to overlay colors on the photoreceptor. Monochromatic processes may, however, include multiple passes where necessary to achieve higher image density or a drier image on the final image receptor, for example.

A single-pass electrophotographic process for developing multiple color images is also known and may be referred to as a tandem process. A tandem color imaging process is discussed, for example in U.S. Pat. No. 5,916,718 and U.S. Pat. No. 5,420,676. In a tandem process, the photoreceptor accepts color toners from development units that are spaced from each other in such a way that only a single pass of the photoreceptor results in application of all of the desired colors thereon.

In an exemplary four-color tandem process, each color may be applied sequentially to a photoreceptive element that travels past each development unit, overlaying each successive color plane on the photoreceptor to form the complete four-color image, and subsequently transferring the four-color image in registration to a final image receptor. For this exemplary process, the steps of photoreceptor charging, exposure, and development are generally performed four times, once for each successive color, while the steps of transfer, fusing, cleaning, and erasure are generally performed only once. After developing the four-color image on the photoreceptor, the image may be transferred directly to the final image receptor or alternatively, to an intermediate transfer member and then to a final image receptor.

In another type of multi-color tandem imaging apparatus, each individual color's development unit may include a small photoreceptor on which each color's contribution to the total image is plated. As an intermediate transfer member passes each photoreceptor, the image is transferred to the intermediate transfer member. The multi-color image is thereby assembled on the intermediate transfer element in overlaid registration of each individual colored toner layer, and subsequently transferred to the final image receptor.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically a nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

A typical toner particle for a liquid toner composition generally comprises a visual enhancement additive (for example, a colored pigment particle) and a polymeric binder. The polymeric binder fulfills functions both during and after the electrophotographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like. Exemplary liquid toners and liquid electrophotographic imaging process are described by Schmidt, S. P. and Larson, J. R. in Handbook of Imaging Materials Diamond, A. S., Ed: Marcel Dekker: New York; Chapter 6, pp 227-252.

The liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30° C. and volume mean particle diameter between 0.1-1 micron. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68-74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40° C. and volume mean particle diameter between 3-10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer.

Photoreceptors generally have a photoconductive layer that transports charge (by an electron transfer or hole transfer mechanism) when the photoconductive layer is exposed to activating electromagnetic radiation or light. The photoconductive layer is generally affixed to an electroconductive support, such as a conductive drum or an insulative substrate that is vapor coated with aluminum or another conductor. The surface of the photoreceptor can be either negatively or positively charged so that when activating electromagnetic radiation imagewise strikes the surface of the photoconductive layer, charge is conducted through the photoreceptor to neutralize, dissipate or reduce the surface potential in those activated regions to produce a latent image.

An optional barrier layer may be used over the photoconductive layer to protect the photoconductive layer and thereby extend the service life of the photoconductive layer. Other layers, such as adhesive layers, priming layers, or charge injection blocking layers, are also used in some photoreceptors. These layers may either be incorporated into the photoreceptor material chemical formulation, or may be applied to the photoreceptor substrate prior to the application of the photo receptive layer or may be applied over the top of photoreceptive layer. A "permanently bonded" durable release layer may also be used on the surface of the photoreceptor to facilitate transfer of the image from the photoreceptor to either the final substrate, such as paper, or to an intermediate transfer element, particularly when an adhesive transfer process is used. U.S. Pat. No. 5,733,698 describes an exemplary durable release layer suitable for use in imaging processes using adhesive transfer.

Many electrophotographic imaging processes make use of intermediate transfer members (ITM's) to assist in transferring the developed toner image to the final image receptor. In particular, in a multipass electrophotographic process, these ITM's may contact the final image formed on the photoreceptor to assist transfer of entire image to the ITM. The image may then be transferred from the ITM to the final image receptor, typically through contact between the ITM and the final receptor.

In a tandem process, individual photoreceptors layer the images formed by the component colors on the ITM. When the entire image is composed in this manner it is typically transferred to the final image receptor. However, U.S. Pat. No. 5,432,591, for example, discloses the use of an offset roller to remove the entire image from a photoreceptor and transfer it to the final image receptor in a multi-pass liquid electrophotographic process. In various embodiments, the ITM may be an endless belt, a roller or a drum.

One continuing problem in electrophotography is to ensure that the toner particles transfer efficiently from the photoreceptor to the final image receptor, either directly or indirectly using an intermediate transfer member. Frequently, a noticeable percentage of the toner layer is left behind at each transfer step, resulting in reduced image fidelity, low optical density and poor image quality on the final image receptor, and toner residues on various machine surfaces that must be efficiently cleaned. This problem of low transfer efficiency is particularly troublesome for liquid electrophotographic toners, wherein slight variations in the carrier liquid content of the toned image can control the efficiency of elastomeric transfer or electrostatic transfer of the image from the photoreceptor or to a final image receptor.

Various attempts have been made to use transfer layers to assist transfer of liquid toned images from a temporary image receptor (e.g. a photoreceptor) or to a final image receptor (e.g. paper). For electrostatic or ionographic printing processes, a dielectric peel layer has been used to augment transfer from a temporary image receptor (see e.g. U.S. Pat. No. 5,176,974). Alternatively, an adhesive-coated protective laminating film has been used to augment transfer of liquid toners from a temporary electrographic receptor (see e.g. U.S. Pat. No. 5,370,960).

For liquid electrophotographic printing, a substantially continuous and uniform coating of a high viscosity or non-Newtonian liquid transfer layer has been applied to assist toner particle transfer from a photoreceptor and to a final image receptor using elastomeric or adhesive transfer. A variety of peelable or releasable transfer assist films have also been used in liquid electrophotographic printing processes wherein the photoreceptor has a surface release characteristic and elastomeric (adhesive) transfer is used to transfer the toned image from the photoreceptor surface. The peelable or releasable film is said to improve toner transferability, provide high quality and high fidelity multicolor images irrespective of the type of final image receptor or image receiving material, and improve storage stability of the final images (see e.g. U.S. Pat. No. 5,648,190, U.S. Pat. No. 5,582,941, U.S. Pat. No. 5,689,785 and U.S. Pat. No. 6,045,956).

Each of these methods for using a transfer assist material in a liquid electrophotographic printing process is directed to multi-pass processes that use adhesive or elastomeric transfer of the image from a specially-prepared photoreceptor having a surface release character, either directly to a final image receptor or indirectly to an intermediate transfer element and then to the final image receptor. Each of these methods involves the application of the transfer assist material as a substantially uniform or continuous film on the photoreceptor. Because the transfer assist material is deposited not only where the toned image is developed, but also in non-imaged background areas, a portion of the transfer material ends up in the background regions on the final image receptor, adding to the expense of using the transfer assist material and potentially degrading the appearance of the final image on plain paper. The art continually searches for improved liquid toner transfer processes, and for methods and materials that allow liquid toner particles to transfer more completely, producing high quality, durable multicolor images on a final image receptor at low cost.

SUMMARY OF THE INVENTION

In one aspect of the invention, a method of producing an image on a final image receptor from image data in a single pass electrophotographic system is provided. The method comprises the steps of providing at least one toner development unit, wherein each toner development unit comprises a photoreceptive element and charged toner particles. The following steps (a) through (d) are preferably performed for each toner development unit: (a) applying a substantially uniform first electrostatic potential to the surface of the photoreceptive element; (b) selectively discharging portions of the surface of the photoreceptive element in an imagewise manner to create a latent image having a second electrostatic potential that is less than the absolute value of the first electrostatic potential on the surface of the photoreceptive element; (c) exposing the surface of the photoreceptive element to the charged toner particles, wherein the charged toner particles selectively deposit on the discharged portions of the surface of the photoreceptive element to develop the latent image and create a toned image; and (d) transferring at least a portion of the toned image on the photoreceptive element to an intermediate transfer member by applying a bias that is sufficiently strong to transfer at least a portion of the toned image from the photoreceptive element to the intermediate transfer member. The method further comprises providing a transfer assist material development unit containing a liquid transfer assist material comprising charged particles and applying the transfer assist material to at least a portion of at least one toned image to form a complete image layer on the intermediate transfer member, wherein the complete image layer is formed in a single pass of the intermediate transfer member. The method further comprises contacting the complete image layer with a final image receptor while applying a bias through the final image receptor that is sufficiently strong to transfer at least a portion of the complete image layer from the intermediate transfer member to the final image receptor. In an alternative embodiment of the present invention, the transfer assist material is applied to the intermediate transfer member prior to the transfer of toner particles to the intermediate transfer member.

In another aspect of the present invention, another method of producing an image on a final image receptor from image data in a single pass electrophotographic system is provided. The method comprises the steps of providing a photoreceptive element and presenting the photoreceptive element to at least one toner development unit, wherein the following steps (a) through (c) are performed in a single pass of the photoreceptive element: (a) applying a substantially uniform first electrostatic potential to the surface of the photoreceptive element; (b) selectively discharging portions of the surface of the photoreceptive element in an imagewise manner to create a first latent image having a second electrostatic potential that is less than the absolute value of the first electrostatic potential on the surface of the photoreceptive element; and (c) exposing the surface of the photoreceptive element to a toner comprising charged toner particles, wherein the charged toner particles selectively deposit on the discharged portions of the surface of the photoreceptive element to develop the first latent image and create a toned image. The method further comprises the steps of providing a transfer assist material development unit containing a liquid transfer assist material comprising charged particles and applying the transfer assist material to the toned image to form a complete image layer on the photoreceptive element, wherein the complete image layer is formed in the single pass of the photoreceptive element. The method also includes the step of contacting the complete image layer with a final image receptor while applying a bias through the final image receptor that is sufficiently strong to transfer at least a portion of the complete image layer from the photoreceptive element to the final image receptor. In an alternative embodiment, the transfer assist material is electrophotographically developed on the photoreceptive element prior to the electrophotographic development of toner particles to the photoreceptive element in an imagewise manner.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Effective transfer of liquid toner throughout the various necessary steps required in an electrophotographic process to reach a final substrate can present some challenges. In accordance with the present invention, the inclusion of a transfer assist layer or transfer assist material in certain tandem electrophotographic processes may provide certain advantages, depending on where in the tandem process this layer is used. A transfer assist layer, as described herein, is not necessarily any one specific material or type of material, although it is preferably a generally clear material, such as nonpigmented ink. In accordance with the present invention, it may be beneficial for a transfer assist layer to have release properties so that the transfer assist layer and the toner layers do not adhere to a photoreceptor, for one example. It is not a requirement that the layer provide release properties, however. A transfer assist layer may also have additional, unique benefits that add value and quality to a print aside from any problem-solving characteristics it may have, as will be discussed in further detail below.

Figure 1:
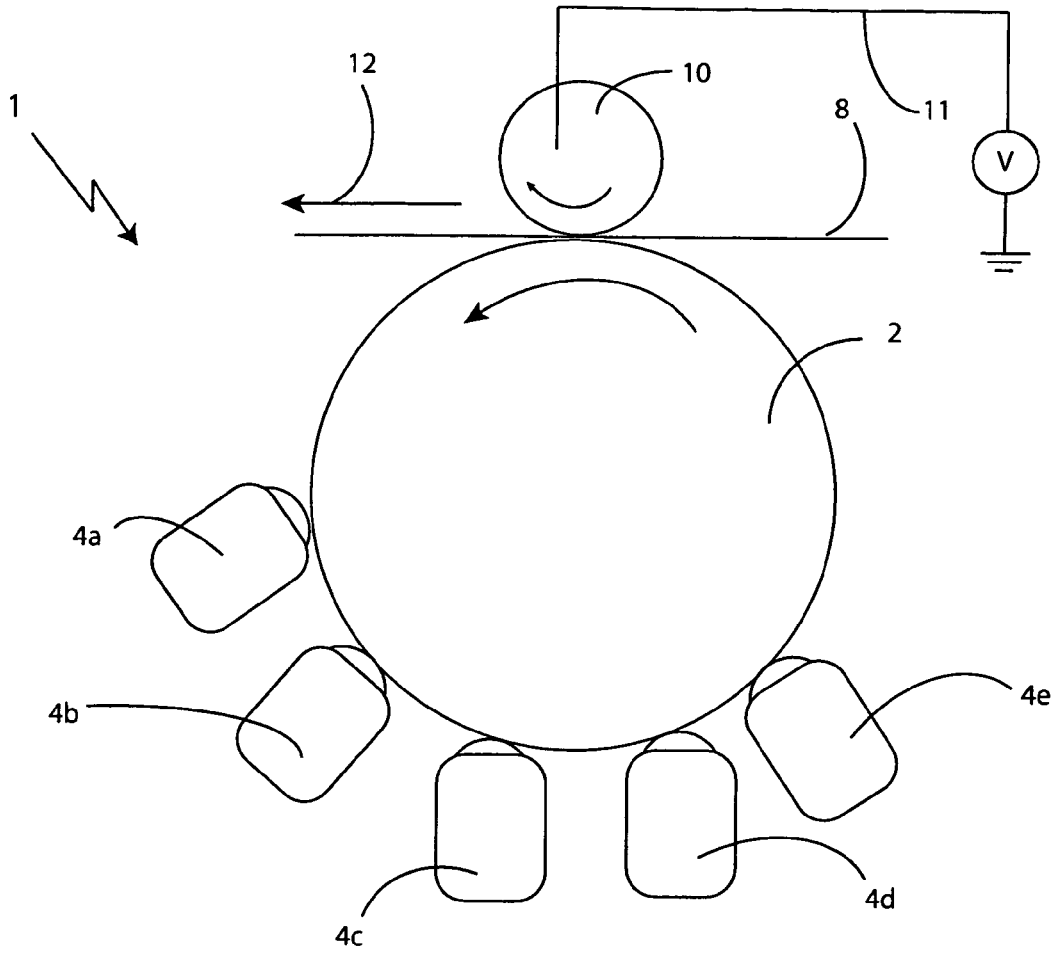
FIG. 1 is a schematic view of a portion of an electrophotographic apparatus using a tandem configuration in an electrostatic transfer process, in accordance with the present invention.

The present invention will be further explained with reference to the appended Figures, wherein like structure is referred to by like numerals throughout the several views, and wherein FIG. 1 is a schematic drawing of the relevant parts of an electrophotographic apparatus 1 using a tandem process that uses electrostatic transfer. A photoreceptor 2 is included in the electrophotographic apparatus 1 and is positioned with multiple development units or stations 4*a*, 4*b*, 4*c*, 4*d*, and 4*e* that are held in place against or adjacent to the photoreceptor 2 throughout the entire printing process. As described herein, the development units or stations may be positioned to be in constant contact with the photoreceptors, or there may instead be a slight gap between the development units or stations and any photoreceptors. If a gap is provided, the electrostatic forces are preferably adjusted to accommodate the additional distance the materials will need to move to transfer to the photoreceptor. When five development units are provided in a particular apparatus, it is preferable that four of the development units provide pigmented liquid ink material and that one development unit provides a transfer assist material. Further, while five development units are provided in this embodiment, more or less than five development units may be provided for a particular electrophotographic apparatus, with a wide variety of possible combinations of the number of development units containing liquid inks and the number of development units containing transfer assist materials within a single electrophotographic apparatus.

The photoreceptor 2 is shown in this non-limiting example as a drum, but may instead be a belt, a sheet, or some other photoreceptor configuration. The development units 4*a*-4*e* preferably each hold charged liquid ink or transfer assist material and include at least one compliant roller that attracts the charged pigmented or nonpigmented ink or toner particles for application of the charged particles to discharged areas on the photoreceptor, as desired. One such compliant roller that may be provided can be referred to as a development roller, which would typically be rotated within its development unit to ensure even coverage of the liquid toner to the photoreceptor, such as is described for example in U.S. Patent Application No. 2002/0114637, which is incorporated herein by reference. It is understood, however, that the development units used within the processes of the present invention may include a wide variety of different configurations and equipment for transferring ink or transfer assist materials to a photoreceptor.

FIG. 1 shows multiple color development units 4*a*, 4*b*, 4*c*, 4*d*, and 4*e* adjacent to the photoreceptor 2. The liquid toner or transfer assist materials (not shown) provided within the development units 4*a*, 4*b*, 4*c*, 4*d*, and 4*e* preferably have a charge director and are each attracted to the discharged regions of the photoreceptor 2 when the discharged regions of the photoreceptor 2 are adjacent to or in contact with one of the development units. This charge director is typically used to facilitate electrostatic transfer of toner particles or transfer assist materials. One example of the preparation of a charged toner is described in U.S. Pat. No. 6,255,363, which is incorporated herein by reference. The charge director, which is sometimes referred to in the art as the charge control agent, typically provides the desired uniform charge polarity of the toner particles. In other words, the charge director acts to impart an electrical charge of selected polarity onto the toner particles as dispersed in the carrier liquid. Preferably, the charge director is coated on the outside of the binder particle. Alternatively or additionally, the charge director may be incorporated into the toner particles using a wide variety of methods, such as copolymerizing a suitable monomer with the other monomers to form a copolymer, chemically reacting the charge director with the toner particle, chemically or physically adsorbing the charge director onto the toner particle, or chelating the charge director to a functional group incorporated into the toner particle.

The preferred amount of charge director or charge control additive for a given toner formulation will depend upon a number of factors, including the composition of the polymer binder. Preferred polymeric binders are graft amphipathic copolymers. The preferred amount of charge director or charge control additive when using an organosol binder particle further depends on the composition of the S portion of the graft copolymer, the composition of the organosol, the molecular weight of the organosol, the particle size of the organosol, the core/shell ratio of the graft copolymer, the pigment used in making the toner, and the ratio of organosol to pigment. In addition, preferred amounts of charge director or charge control additive will also depend upon the nature of the electrophotographic imaging process, particularly the design of the developing hardware and photoreceptive element. It is understood, however, that the level of charge director or charge control additive may be adjusted based on a variety of parameters to achieve the desired results for a particular application.

Any number of charge directors described in the art may be used in the liquid toners or transfer assist materials of the present invention in order to impart an electrical charge of selected polarity onto the toner particles. For example, the charge director may be introduced in the form of metal salts consisting of polyvalent metal ions and organic anions as the counterion. Suitable metal ions include Ba(II), Ca(II), Mn(II), Zn(II), Zr(IV), Cu(II), Al(III), Cr(III), Fe(II), Fe(III), Sb(III), Bi(III) Co(II), La(III), Pb(II), Mg(II), Mo(III), Ni(II), Ag(I), Sr(II), Sn(IV), V(V), Y(III) and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, octanoic acid, lauric acid, tallic acide, and the like. Preferred positive charge directors are the metallic carboxylates (soaps), such as those described in U.S. Pat. No. 3,411,936, incorporated herein by reference. A particularly preferred positive charge control agent is zirconium tetraoctoate (available as Zirconium HEX-CEM from OMG Chemical Company, Cleveland, Ohio).

Any number of charge directors such as those described in the art may be used in the liquid toners or transfer assist materials of the present invention in order to impart a negative electrical charge onto the toner particles. For example, the charge director may be lecithin, oil-soluble petroleum sulfonates (such as neutral Calcium Petronate™, neutral Barium Petronate™, and basic Barium Petronate™, manufactured by Sonneborn Division of Witco Chemical Corp., New York, N.Y.), polybutylene succinimides (such as OLOA™ 1200 sold by Chevron Corp., and Amoco 575), and glyceride salts (such as sodium salts of phosphated mono- and diglycerides with unsaturated and saturated acid substituents as disclosed in U.S. Pat. No. 4,886,726 to Chan et al). A preferred type of glyceride charge director is the alkali metal salt (e.g., Na) of a phosphoglyceride A preferred example of such a charge director is Emphos™ D70-30C, Witco Chemical Corp., New York, N.Y., which is a sodium salt of phosphated mono- and diglycerides.

The preferred charge direction levels for a given toner formulation will depend upon a number of factors, including the composition of a graft stabilizer and organosol, the molecular weight of the organosol, the particle size of the organosol, the liquid carrier chosen, the core/shell ratio of the graft stabilizer, the pigment used in making the toner, and the ratio of organosol to pigment. In addition, preferred charge direction levels will also depend upon the nature of the electrophotographic imaging process, particularly the design of the developing hardware and photoreceptive element. It is understood, however, that the level of charge direction may be adjusted based on a variety of parameters to achieve the desired results for a particular application.

One advantage of a tandem electrophotographic process is that multiple colors may be laid on top of one another in sequence with a single rapid pass of the photoreceptor 2 past multiple development units. Referring again to FIG. 1, once the photoreceptor 2 has received the liquid toner layers and any transfer assist layers, the composite image may be transferred directly to a final image receptor 8 that is traveling in the direction of arrow 12. A transfer roller 10 is biased as shown by the representation 11 to affect an electrostatic transfer of the entire image from the photoreceptor 2 to the final image receptor 8. Because a toned image will preferably be maintained on the photoreceptor 2 due to electrostatic attraction forces, a significantly greater electrical field will be necessary to attract or pull the charged toner particles away from the photoreceptor 2 toward the final image receptor 8. Thus, by applying a relatively high electrical voltage of the proper polarity to the transfer roller 10, the electrical field between the photoreceptor 2 and the transfer roller 10 cause the toner particles to deposit on the final image receptor 8.

In accordance with the present invention, at least one of the development units 4*a*-4*e* contains a transfer assist layer for application to the photoreceptor 2. The selection of the development unit 4*a*-4*e* in which the transfer assist layer will be placed is made based on a variety of factors, as will be described below. A transfer assist layer in this type of apparatus may be a colorless liquid such as an unpigmented liquid toner (organosol) that contains charge director. The charge director will enable the transfer assist material to electrostatically transfer to the area to be imaged (or that is already imaged) on the photoreceptor 2 and to the final receptor 8. In this process, because the liquid toner development units 4*a*, 4*b*, 4*c*, 4*d*, 4*e* are in constant contact with or adjacent to the photoreceptor 2 in a relatively fixed position, the transfer assist material must be placed in one of the development units in sequence within the imaging process in the order in which the transfer assist layer or layers should be laid. In other words, because the development units typically will not be moved during a particular printing sequence, a development unit or units containing transfer assist material will preferably be positioned relative to the photoreceptor and the other development units in the particular locations that allow the desired layering of pigmented inks and transfer assist materials.

The other development units of a particular electrophotographic apparatus, which may be referred to as toner development units, preferably contain the colors cyan (C), magenta (M), yellow (Y), and black (K), but the colors in each development unit may include any colors including, for example, a red (R), green (G), blue (B), and black (K) system, or other variations. In accordance with the present invention, it is understood that any toner layer or image may include one or more colors or layers, but such layers and images are generally shown and described herein as a single toner layer, for clarity of description and illustration. Depending on the development unit in which the transfer assist material is placed, the transfer assist material may be applied to the photoreceptor 2 before the colored toners are applied (for example, by placing the transfer assist material in development unit 4*a*), or over the toned image, as described below (for example, by placing the transfer assist material in development unit 4*e*).

When used as part of a toner composition, various suitable toner resins may be selected for incorporation with the transfer assist materials of the present invention. Illustrative examples of typical resins include polyamides, epoxies, polyurethanes, vinyl resins, polycarbonates, polyesters, and the like and mixtures thereof. Any suitable vinyl resin may be selected including homopolymers or copolymers of two or more vinyl monomers. Typical examples of such vinyl monomeric units include: styrene; vinyl naphthalene; ethylenically unsaturated mono-olefins such as ethylene, propylene, butylene, isobutylene and the like; vinyl esters such as vinyl acetate, vinyl propionate, vinyl benzoate, vinyl butyrate and the like; ethylenically unsaturated diolefins, such as butadiene, isoprene and the like; esters of unsaturated monocarboxylic acids such as methyl acrylate, ethyl acrylate, n-butyl acrylate, isobutyl acrylate, dodecyl acrylate, n-octyl acrylate, phenyl acrylate, methyl methacrylate, ethyl methacrylate, butyl methacrylate and the like; acrylonitrile; methacrylonitrile; vinyl ethers such as vinyl methyl ether, vinyl isobutyl ether, vinyl ethyl ether and the like; vinyl ketones such as vinyl methyl ketone, vinyl hexyl ketone, methyl isopropenyl ketone and the like; and mixtures thereof. Also, there may be selected as toner resins various vinyl resins blended with one or more other resins, preferably other vinyl resins, which insure good triboelectric properties and uniform resistance against physical degradation. Furthermore, nonvinyl type thermoplastic resins may also be employed including resin modified phenolformaldehyde resins, oil modified epoxy resins, polyurethane resins, cellulosic resins, polyether resins, polyester resins, and mixtures thereof.

Preferably, the toner comprises a graft amphipathic copolymer that has been dispersed in a liquid carrier to form an organosol, then mixed with other ingredients to form a liquid toner composition. Typically, organosols are synthesized by nonaqueous dispersion polymerization of polymerizable compounds (e.g. monomers) to form copolymeric binder particles that are dispersed in a low dielectric hydrocarbon solvent (carrier liquid). These dispersed copolymer particles are sterically-stabilized with respect to aggregation by chemical bonding of a steric stabilizer (e.g. graft stabilizer), solvated by the carrier liquid, to the dispersed core particles as they are formed in the polymerization. Details of the mechanism of such steric stabilization are described in Napper, D. H., "Polymeric Stabilization of Colloidal Dispersions," Academic Press, New York, N.Y., 1983. Procedures for synthesizing self-stable organosols are described in "Dispersion Polymerization in Organic Media," K. E. J. Barrett, ed., John Wiley: New York, N.Y., 1975.

Once the organosol has been formed, one or more additives can be incorporated, as desired. For example, one or more visual enhancement agents (such as tinting materials) and/or charge control directors or agents can be incorporated. The composition can then subjected to one or more mixing processes, such as homogenization, microfluidization, ball-milling, attritor milling, high energy bead (sand) milling, basket milling or other techniques known in the art to reduce particle size in a dispersion. The mixing process acts to break down aggregated visual enhancement additive particles, when present, into primary particles (having a diameter in the range of 0.05 to 5 microns) and may also partially shred the dispersed copolymeric binder into fragments that can associate with the surface of the visual enhancement additive.

The dispersed copolymer or fragments derived from the copolymer may then associate with the visual enhancement additive, for example, by adsorbing to or adhering to the surface of the visual enhancement additive, thereby forming toner particles. The result is a sterically-stabilized, nonaqueous dispersion of toner particles having a volume mean particle diameter (determined with laser diffraction) in the range of about 0.05 to about 50.0 microns, more preferably in the range of about 1 to about 10 microns, most preferably in the range of about 1.5 to about 5 microns. In addition, the toner particles used for the electrostatic transfer processes of the present invention preferably have effective glass transition temperatures greater than about 35° C., and may be above about 40° C. In some embodiments, one or more charge control directors or agents can be added before or after mixing, if desired.

The liquid carrier of the pigmented inks and non-pigmented toner assist materials is preferably a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water. The carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred carrier liquids have a Hildebrand solubility parameter of from about 13 to about 15 $MPa^{1/2}$.

The liquid carrier of the toner compositions of the present invention is preferably the same liquid as used as the solvent for preparation of the amphipathic copolymer. Alternatively, the polymerization may be carried out in any appropriate solvent, and a solvent exchange may be carried out to provide the desired liquid carrier for the toner composition.

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and are seen in the low relationship between current density and toner deposited during development. Low conductivities indicate little or no charging of the toner particles and lead to very low development rates. The use of charge control directors or agents matched to adsorption sites on the toner particles is a common practice to ensure sufficient charge associates with each toner particle.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, and the like.

Figure 2A:
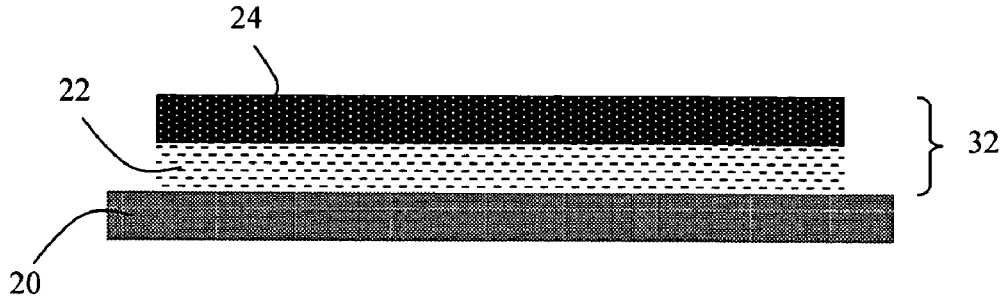
FIGS. 2*a* and 2*b* are side schematic views of an arrangement of toner and transfer assist layers in the steps involving toner transfer from a photoreceptor to a final receptor, wherein a transfer assist layer is applied to the photoreceptor before an ink/toner layer is applied.
Figure 2B:
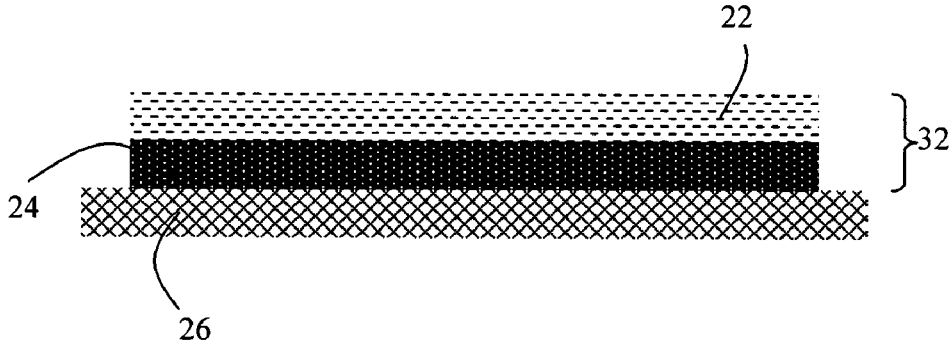

FIG. 2*a* shows a transfer assist layer 22 as applied or positioned on a photoreceptor 20, such as could be applied by an apparatus such as the apparatus 1 of FIG. 1. A toner layer 24, which may include one or more colors applied in any desired sequence, is applied or positioned so that it at least partially covers the transfer assist layer 22. FIG. 2*b* illustrates the arrangement of the layers of FIG. 2*a* in its configuration after the image is transferred to a final image receptor 26. When the transfer assist layer 22 is placed on the photoreceptor 20 before the toner layer or layers 24, as in this embodiment, transfer of the image to the final receptor 26 places the toner layer 24 in direct contact with the final receptor 26 and places the transfer assist layer 22 on the outside. Any of the various combinations of transfer assist layer or layers 22 and the toner layer 24 are described herein as a complete or total image layer 32.

When the transfer assist layer 22 is applied to the photoreceptor 20 before the toner layer or layers 24 in this way, the layer 22 may provide any of several advantages. Typically, when choosing toner particle sizes for electrophotographic applications that use electrostatic transfer, the size of the pigmented ink particles is an important consideration. Preferably, the volume mean particle diameter (determined with laser diffraction, for example) of the particles is in the range of about 0.05 to about 50.0 microns, more preferably in the range of about 1 to about 10 microns, and most preferably in the range of about 1.5 to about 5 microns. If the pigmented ink particles are relatively large, such as between about 1 and 5 microns, for example, the toner may transfer relatively easily from the photoreceptor to another member such as an optional intermediate transfer member, for example. However, these large pigmented ink particles may also produce uneven print images because there may be gaps or voids in the toned images due to the fact that the particles are too large to evenly cover the print surface. Conversely, relatively small pigmented ink particles (e.g., less than 1 micron) can produce a very fine resolution image in some cases; however, because the particles are so small, a relatively thick layer of toner may be needed to provide the desired density of the image. This relatively thick toner layer can be too thick to transfer properly, which may result in leaving some or all of the toner layers behind (i.e., the toner layers do not transfer from a substrate). Thus, it can be advantageous, in accordance with the present invention, to provide a transfer assist layer having relatively large pigmented ink particles adjacent to (e.g., underneath or over) a relatively thick layer of small particle toner pigment to help the entire pigmented layer transfer more efficiently, resulting in a more complete toner transfer that maintains the desired optical density. Preferably, the volume mean particle diameter (determined with laser diffraction, for example) of the charged transfer assist material particles is in the range of about 0.05 to about 50.0 microns, more preferably in the range of about 1 to about 10 microns, and most preferably in the range of about 1.5 to about 5 microns.

Thus, the direct transfer of the toner layer 24 from the photoreceptor 20 to the final substrate 26 may be improved by charging the transfer assist layer 22 and by using a relatively large particle size for the particles in the transfer assist material. Further, a transfer assist layer may serve as a release layer, with some or all of the transfer assist layer transferring to the final image receptor with the pigmented particles of the final image. The transfer layer, which is preferably transparent, may then fill in microscopic voids or gaps in the toner layer, thereby improving the image appearance or optical density of the image. Some examples of transfer assist materials that can be used for release include organosols that incorporate release functionality, typically in the graft stabilizer, where specific examples include graft stabilizers comprising silicone monomers or polydimethylsiloxane. Other examples of materials that can help provide release properties include those discussed in U.S. Pat. Nos. 5,521,271, 5,604,070, and 5,919,866, which provide lists of examples of polymeric dispersions that include surface release promoting moieties, the disclosures of which are incorporated herein by reference. In order to further promote release properties (i.e., minimize or eliminate tackiness), it is further preferable that the transfer assist material has a glass transition temperature greater than about 35° C. and may be greater than about 40° C.

Figure 3A:
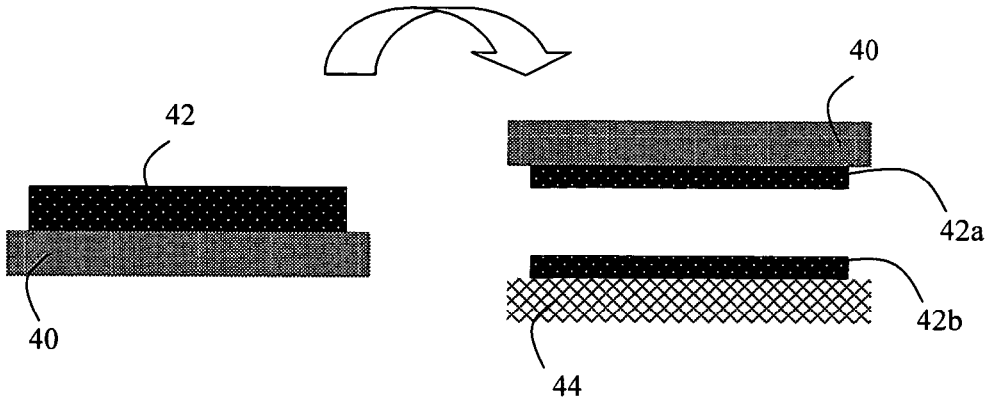
FIGS. 3*a* and 3*b* are side schematic views of toner and transfer assist layers arranged relative to each other, including splitting of layers with and without the use of a transfer assist layer.
Figure 3B:
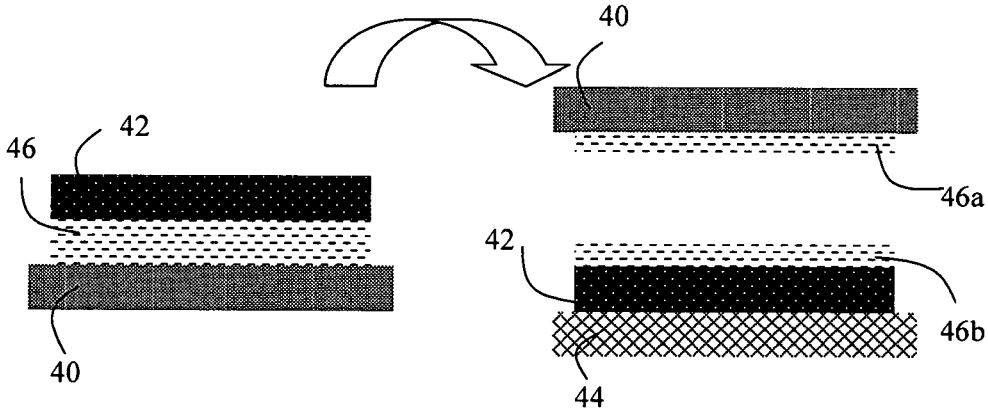

FIGS. 2*a* and 2*b* show how a transfer assist layer may be incorporated to provide complete release from a photoreceptor, but complete (100%) transfer may not be necessary when a transfer assist layer is used. In FIGS. 3*a* and 3*b*, for example, the transfers of an image with and without a transfer assist layer are illustrated, where FIG. 3*b* shows the use of a transfer assist layer as a "sacrificial layer". First, in FIG. 3*a*, a photoreceptor 40 is shown having a toned image (toner layer) 42 thereon. As indicated by the arrow, the second step of this process shows transfer of that image to a final receptor 44 in which the entire toner layer 42 does not transfer. This figure shows that if there is incomplete toner transfer, only a portion of the toner layer 42 is transferred to the final receptor 44 and is shown as a layer 42*b* (a partial layer). The portion 42*a* that remains behind on the photoreceptor 40 is toner that contributed to the quality and optical density of the image. The result can be an image on a final substrate having diminished optical quality and a "papery" appearance due to the presence of scattered microvoids in the image.

FIG. 3*b* shows the same phenomenon where a transfer assist layer is used, in accordance with the present invention. In particular, a photoreceptor 40 with a layer of transfer assist material 46 and a layer of toner 42 is provided. As indicated by the arrow, the second step of this process occurs when it is desired to transfer the image to the final substrate. As shown in this figure, the transfer assist layer 46 "splits" or divides in such a way that a portion of the transfer assist layer 46*b* goes with the toner layer 42 to the final image receptor 44, and a portion of the transfer assist layer 46*a* remains behind on the photoreceptor 40. Advantageously, the entire toner image layer 42 is thereby transferred to the final image receptor 44, thereby assisting in maintaining a desirable optical density of the image.

This process may have additional advantages not related to transfer assistance. For example, a transfer assist layer may have additives to make it a durable image protectant when the image is fixed or fused to the final receptor. Examples of such additives include organosols that incorporate high $T_g$ monomers, such as TCHMA, isobornylacrylate, or isobornylmethacrylate, (as is described, for example, in co-pending U.S. patent application of the present Assignee Ser. No. 10/612,765, filed Jun. 30, 2003, entitled "ORGANOSOL INCLUDING HIGH TG AMPHIPATHIC COPOLYMERIC BINDER AND LIQUID TONERS FOR ELECTROPHOTOGRAPHIC APPLICATIONS", the entire content of which is incorporated herein by reference, or that incorporate covalently bonded polymerizable, crystallizable monomers such as acrylates or methacrylates with carbon numbers including and between $C_{16}$ and $C_{26}$ (e.g., hexadecyl-acrylate or -methacrylate, stearyl-acrylate or -methacrylate, or behenyl-acrylate or -methacrylate) (as is described, for example, in co-pending U.S. patent application of the present Assignee Ser. No. 10/612,534, filed Jun. 30, 2003, entitled "ORGANOSOL LIQUID TONER INCLUDING AMPHIPATHIC COPOLYMERIC BINDER HAVING CRYSTALLINE COMPONENT", the entire content of which is incorporated herein by reference). The transfer assist layer can also be adjusted to have properties that, for example, offer abrasion resistance or protection from ultraviolet light. It can also be modified to provide a glossy surface, enhancing the way the image looks on the final receptor. These features are not requirements of an effective transfer assist layer, but they could be elements of an enhanced transfer assist layer that solves other imaging problems or defects.

As discussed above with respect to FIG. 1, the transfer assist material may be placed in any development unit position (4*a*, 4*b*, 4*c*, 4*d*, or 4*e*) for plating to the photoreceptor 2. However, the embodiments described above include processes in which the development unit containing the transfer assist material applies the transfer assist material to the photoreceptor prior to the application of any toner materials, for example, in development unit 4*a*. The transfer assist layer may instead be applied to the photoreceptor 2 after the toned image is layered on the photoreceptor, for example in development unit 4*e*, as described below.

Figure 4A:
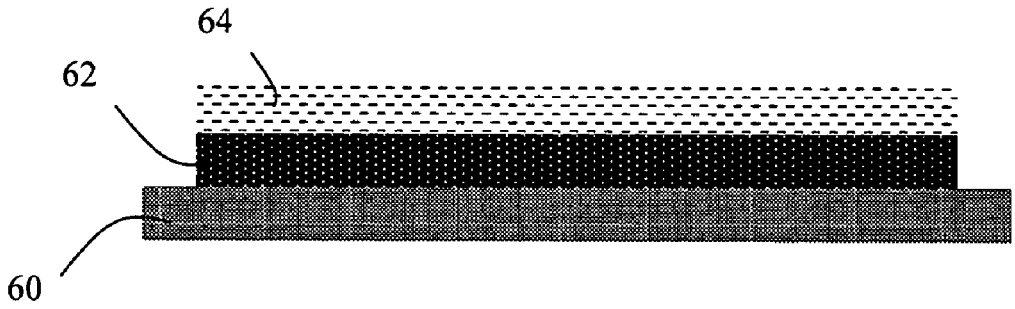
FIGS. 4*a* and 4*b* are side schematic views of an arrangement of toner and transfer assist layers in the steps involving toner transfer from a photoreceptor to a final receptor, wherein a transfer assist layer is applied to the photoreceptor after an ink/toner layer is applied.
Figure 4B:
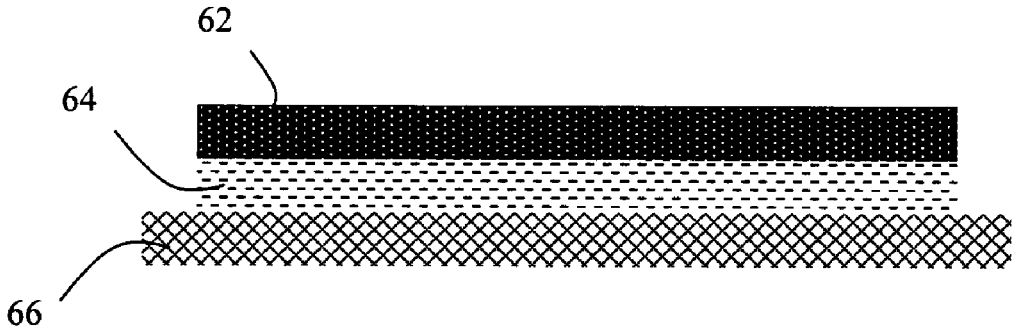

FIGS. 4*a* and 4*b* illustrate another embodiment of the present invention in which the layers and the transfer steps are shown for a process wherein a transfer assist layer is initially placed over the toned image. In particular, FIG. 4*a* shows a photoreceptor 60, with a complete toned image positioned thereon made up of at least one toner layer 62 and a transfer assist layer 64 at least partially covering the toner layer 62. When the image is then transferred to the final receptor 66 (as shown in FIG. 4*b*), the transfer assist layer 64 contacts the final image receptor 66 and the toner layer 62 is on the outside (i.e., the toner layer 62 is the top layer).

This embodiment of FIGS. 4*a* and 4*b* illustrates the improved transfer efficiency that may be achieved through the use of a transfer assist layer in this position. In particular, this transfer efficiency may be enhanced due to the thicker toner layer of charged particles that tends to encourage electrostatic transfer through the addition of more charged particles. A transfer assist layer used in this way does not necessarily promote transfer efficiency by providing a layer for release or splitting from the photoreceptor. However, in this embodiment, the transfer assist layer can be used to bond electrically with relatively small pigment particles, thereby creating stronger cohesive strength and larger charged particles to enhance and improve transfer efficiency and quality.

Further, this embodiment of a transfer assist layer may be formulated to have a tacky surface, thereby encouraging a bond between the pigmented toner particles and the final image receptor. In fact, if the glass transition temperature ($T_g$)

is formulated to be relatively low (making it tacky), it is possible that a relatively low to moderate fusing temperature can enable the pigment particles to melt and flow more easily into a porous final receptor, thereby creating a strong bond between the toner and the final receptor. Preferably, the transfer assist layer of this embodiment has a $T_g$ that is lower than about 35° C. and could be below about −10° C. In addition, the transfer assist layer can include enhancement properties that facilitate fusing of the image at lower temperatures than without such a transfer assist layer, which can provide benefits from a manufacturing and safety standpoint. Additionally, this embodiment may have benefits that are not necessarily related to improving transfer efficiency, such as providing a base coat (that might promote, for example, adhesion) between the toned image and the final substrate. This might be particularly useful with respect to the printing of liquid toners on overhead projection film (OHP film), for example.

Figure 5A:
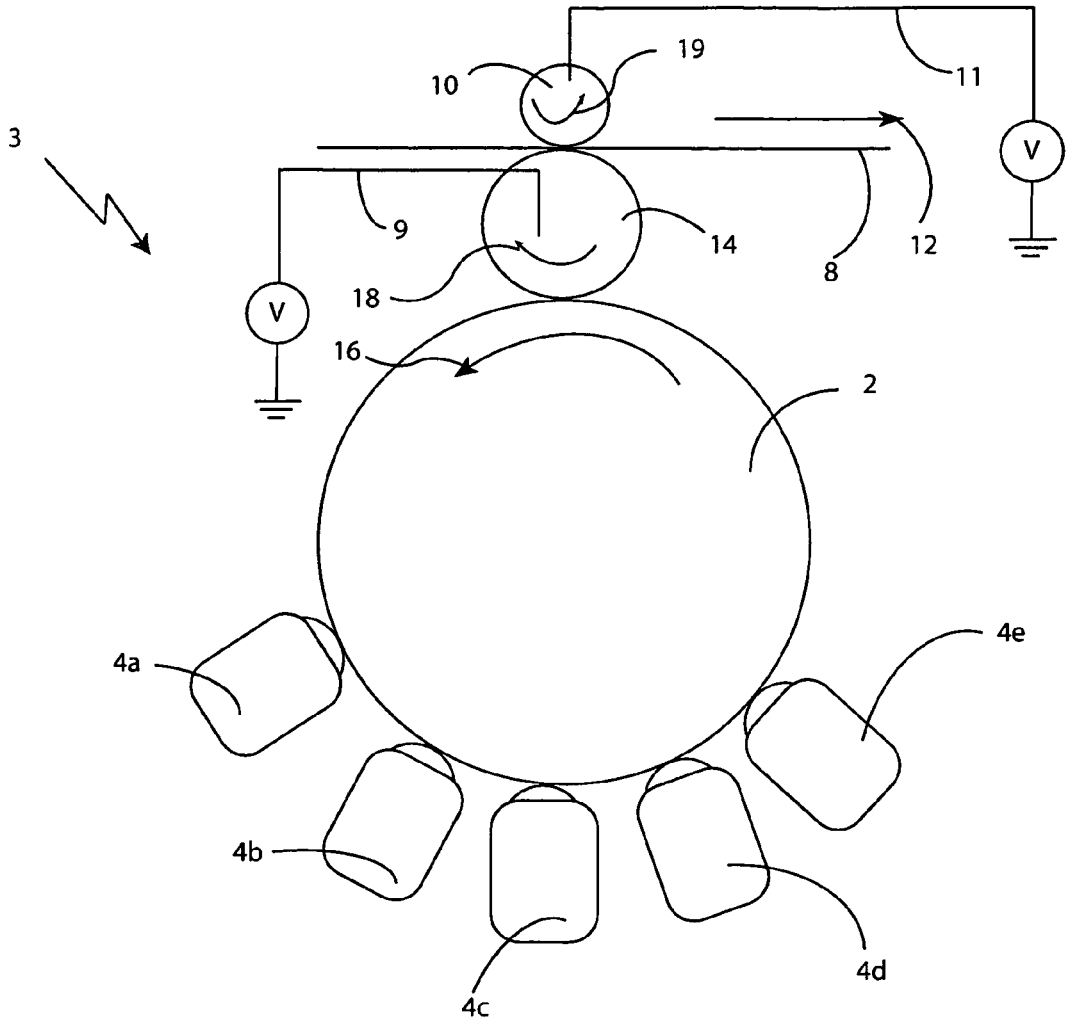
FIG. 5*a* is a schematic view of a portion of an electrophotographic apparatus using a tandem process that uses electrostatic transfer and an intermediate transfer member.
Figure 5B:
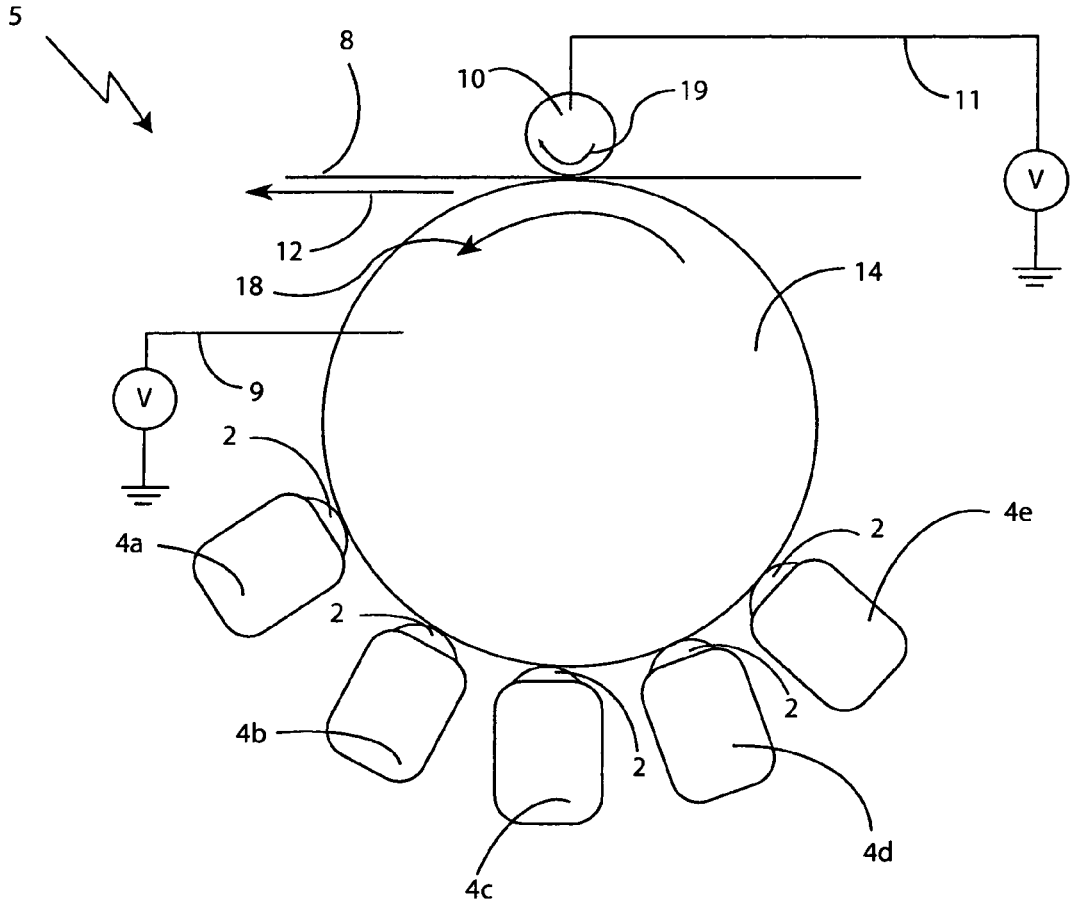
FIG. 5*b* is a schematic view of a portion of an electrophotographic apparatus, using a tandem process with an intermediate transfer member with each development unit having its own photoreceptor.

FIGS. 5*a* and 5*b* show two embodiments of electrophotographic apparatuses 3 and 5, respectively, in accordance with the present invention, which are similar to the apparatus of FIG. 1. The apparatuses 3 and 5 additionally incorporate the use of an intermediate transfer member 14 positioned between at least one photoreceptor 2 and a transfer roller 10.

In FIG. 5*a*, a photoreceptor 2 is included in the electrophotographic apparatus 3 and is positioned so that multiple development units 4*a*, 4*b*, 4*c*, 4*d*, and 4*e* are situated against or adjacent to the photoreceptor 2 at all times. While five development units are provided in this embodiment, more or less than five development units may be provided for a particular electrophotographic apparatus. These units may comprise at least one development unit containing toner and at least one development unit containing transfer assist material. The photoreceptor 2 is shown in this non-limiting example as a drum, but may instead be a belt, a sheet, or some other photoreceptor configuration.

In a single pass in this tandem process, the desired number of toner layers and possibly also the desired number of transfer assist material layers are applied to the photoreceptor 2 by the various development units. The toned image, which may or may not include at least one transfer assist material layer, is then transferred to the intermediate transfer member 14 (shown here as an intermediate transfer roller, but which may be a sheet, drum, or belt) before transfer to the final image receptor 8. To accomplish this, the intermediate transfer member 14 is preferably biased to provide a stronger electrostatic pull on the toned image than is provided by the photoreceptor 2. In this way, the image may be transferred to the intermediate transfer member 14 as it rotates in a direction shown by arrow 18. The final image receptor 8, which is moving in a direction indicated by arrow 12, may then be pressed against the intermediate transfer member 14 by the transfer roller 10, which is preferably biased as shown by system 11 and is rotating in a direction indicated by arrow 19. As the image rotates along the outer perimeter of the intermediate transfer member 14 to come in contact with the final receptor 8, the bias of the transfer roller 10 attracts the toner and any charged transfer assist material particles to the final receptor 8.

In FIG. 5*b*, a related electrophotographic system 5 using an intermediate transfer member 14 is shown. In this configuration, each of the development units 4*a*-4*e* has its own photoreceptor 2. These units may comprise at least one development unit containing toner and at least one development unit containing transfer assist material. Because the materials from which most intermediate transfer members 14 are made are preferably resistive (e.g., between $10^8$-$10^{14}$ ohms), any intermediate transfer member 14 of the present invention may have a conductive layer, roller, or material (not shown) underneath or behind the layer that contacts the photoreceptor 2 to provide a bias that is substantial enough to pull the toner on each photoreceptor 2 to the surface of the intermediate transfer member 14. However, the surface layer of the intermediate transfer member 14 may instead be more conductive such that it may be independently biased to facilitate the transfer without backup biasing. As the intermediate transfer member 14 rotates about its midpoint in a direction shown by arrow 18 in FIG. 5*b*, each photoreceptor 2 in each development unit 4*a*-4*e* contributes a portion of the complete image to the final image being composed on the intermediate transfer member 14. When the final toned image is completely composed on the intermediate transfer member 14, it is transferred to the final image receptor 8. The transfer roller 10, which is rotating in a direction shown by arrow 19, is biased by electrical system 11 strongly enough to pull the toned image from the intermediate transfer member 14 to the final image receptor 8, traveling in a direction shown by arrow 12.

Figure 6A:
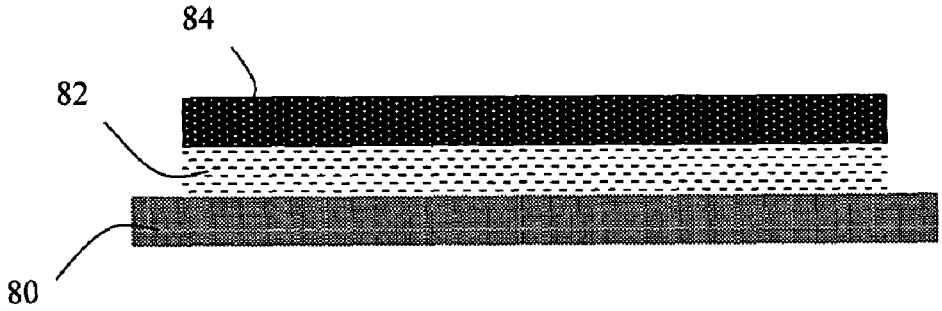
FIGS. 6*a*, 6*b* and 6*c* are side schematic views of an arrangement of toner and transfer assist layers in the steps involving toner transfer from a photoreceptor to an intermediate transfer member, then to a final receptor, wherein a transfer assist layer is applied to the photoreceptor before an ink/toner layer is applied.
Figure 6B:
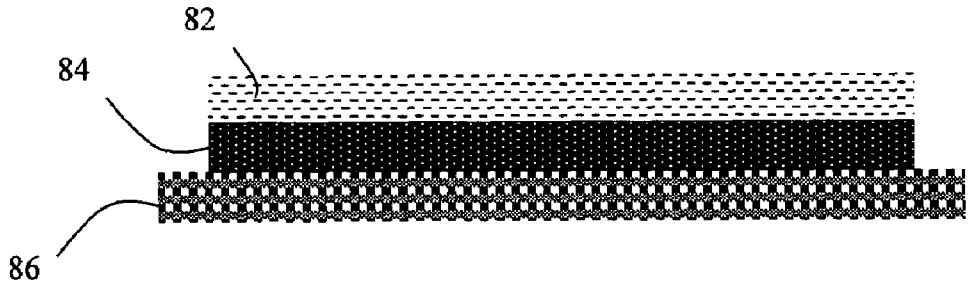
Figure 6C:
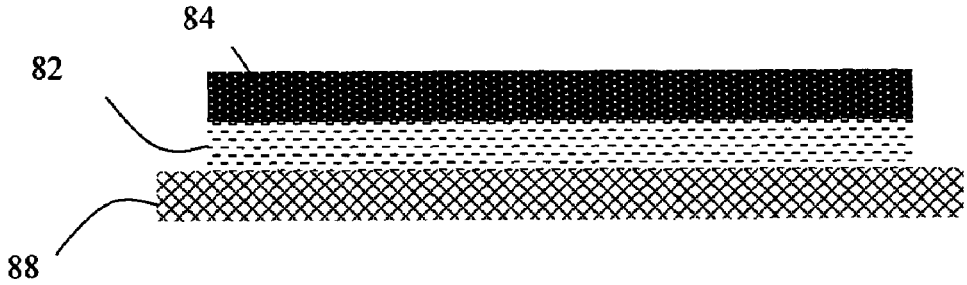

As discussed relative to FIG. 1, a transfer assist layer may be applied either before or after the application of a liquid toner on the photoreceptor. This placement is controlled by which development unit contains the transfer assist layer (e.g., any of the development units 4*a*-4*e* in FIGS. 5*a* and 5*b*). In another embodiment of the present invention, FIG. 6*a* shows a first step of an electrophotographic process using equipment similar to that shown in FIG. 5*a*. In FIG. 6*a*, a transfer assist layer 82 is first applied to a photoreceptor 80, then a toner layer 84 comprising one or more toner colors is applied on top of the transfer assist layer 82. When the toner accumulation is complete, the complete image layer may then be transferred to an intermediate transfer member 86, as shown schematically in FIG. 6*b*. In this step, the toner layer 84 is transferred to the intermediate transfer member 86, and the transfer assist layer 82 is then "on top" of the layers. A final step of this process is illustrated in FIG. 6*c*, in which the image is transferred to the final receptor or substrate 88. This results in the transfer assist layer 82 being positioned between the final receptor 88 and the toner layer 84, with the toner layer 84 "on top."

In this embodiment of the process (i.e., using an intermediate transfer member), the transfer assist layer can function either as a release layer as described for FIGS. 2*a* and 2*b*, or as a "sacrificial layer" that can split as described for FIG. 3*b*. These functions of the transfer assist layer are primarily determined by the position of this layer relative to the photoreceptor and toner layers. In one aspect, the transfer assist layer shown as layer 82 in FIGS. 6*a* through 6*c* may be partially left on the photoreceptor 80 (not shown) in the transfer to the intermediate transfer member 86. In this embodiment, the transfer assist layer 82 in FIG. 6*b* would be at least slightly less thick than the initial transfer assist layer 82 of FIG. 6*a*. The transfer assist layer 82 can also function as described relative to FIG. 4, improving transfer by chemical and electrical bonding with the toner particles 84 and encouraging adhesion to the final receptor 88. Additionally, all of the additional benefits and properties discussed above that are unrelated to the actual transfer performance and that may be included in the transfer assist layer (including abrasion and UV protection and adhesion promotion, for example) may also be included within the scope of this embodiment.

In the embodiment of the present invention shown in FIG. 5*b*, the layers shown in FIG. 6*a* could alternatively include only the toner layer 84 applied on the photoreceptor 80 (i.e., the transfer assist layer 82 would not be applied in this step). Instead of applying the transfer assist material layer to the photoreceptor over the toned image layer, the transfer assist layer 82 could be initially applied over at least a portion of the toner layer 84 after it has been transferred to the intermediate transfer member 86 in FIG. 6*b*. FIG. 5*b* shows a larger intermediate transfer member 14 that provides enough space for a development unit to imagewise transfer or applicator to meter the transfer assist layer 82 on top of the final toned image on the intermediate transfer member 14.

Figure 7A:
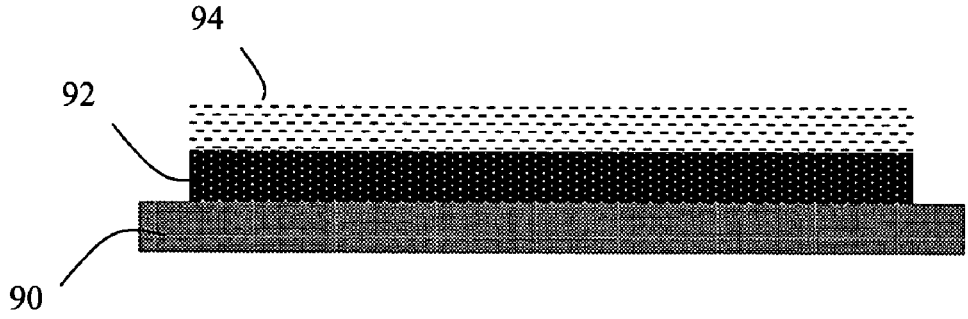
FIGS. 7*a*, 7*b* and 7*c* are side schematic views of an arrangement of toner and transfer assist layers in the steps involving toner transfer from a photoreceptor to an intermediate transfer member, then to a final receptor, wherein a transfer assist layer is applied to the photoreceptor after an ink/toner layer is applied.
Figure 7B:
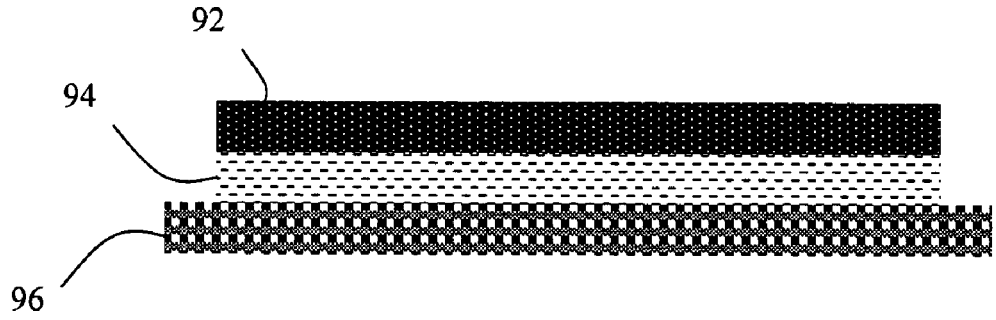
Figure 7C:
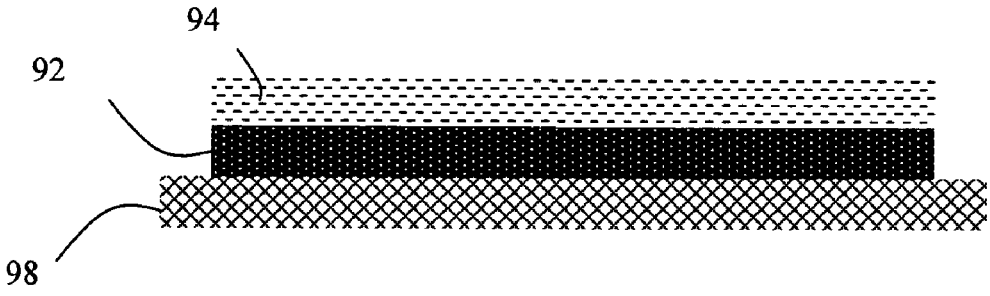

FIGS. 7*a*-7*c* illustrate the transfer steps and layer arrangement for a process using an intermediate transfer member, where the transfer assist layer is placed on the photoreceptor after the toned image is completely formed. As shown in FIG. 7*a*, a toner layer 92 is applied to or positioned on a photoreceptor 90, with a transfer assist layer 94 applied over the top of the toned image 92. In the next step of the process, shown in FIG. 7*b*, the image is transferred to the intermediate transfer member 96, leaving the transfer assist layer 94 in contact with the intermediate transfer member 96 and the toner layer 92 exposed. A final step in this process is shown in FIG. 7*c*, in which the image is transferred to a final receptor 98, so that the toner layer 92 is in contact with the receptor 98 and the transfer assist layer 94 is exposed.

This embodiment advantageously utilizes the ability of the transfer assist layer 94 to act as a release or sacrificial layer from the intermediate transfer member 96, where such advantages of this layer are similar to those described above relative to FIGS. 2 and 3*b*. It is also possible to avoid the application of the transfer assist layer 94 over the toner layer 92 on the photoreceptor 90 (as in FIG. 7*a*), and to instead apply the transfer assist layer 94 with a metering roller or imagewise (not shown) before the toned image on the intermediate transfer member 96. This may be embodied in the apparatus of FIG. 5*b* where the transfer assist material cartridge is in position 4*e* and is applied to the intermediate transfer member 14 prior to the toned image transfer to the intermediate transfer member 14. Additionally, this embodiment takes advantage of the transfer assist layer 94 on the surface of the image 92 on the final receptor 98 to promote such features as ultraviolet protection and abrasion resistance, for example.

These embodiments above describe basic arrangements of using a transfer assist layer in a tandem electrophotographic process that uses electrostatic transfer. In accordance with the present invention, the transfer assist layer can be applied between any toner layers, if desired. Further, it is possible for multiple transfer assist layers to be applied in a particular electrophotographic process, such as may be done so that various transfer assist layers may provide different advantageous properties to the image and processes.

Figure 8:
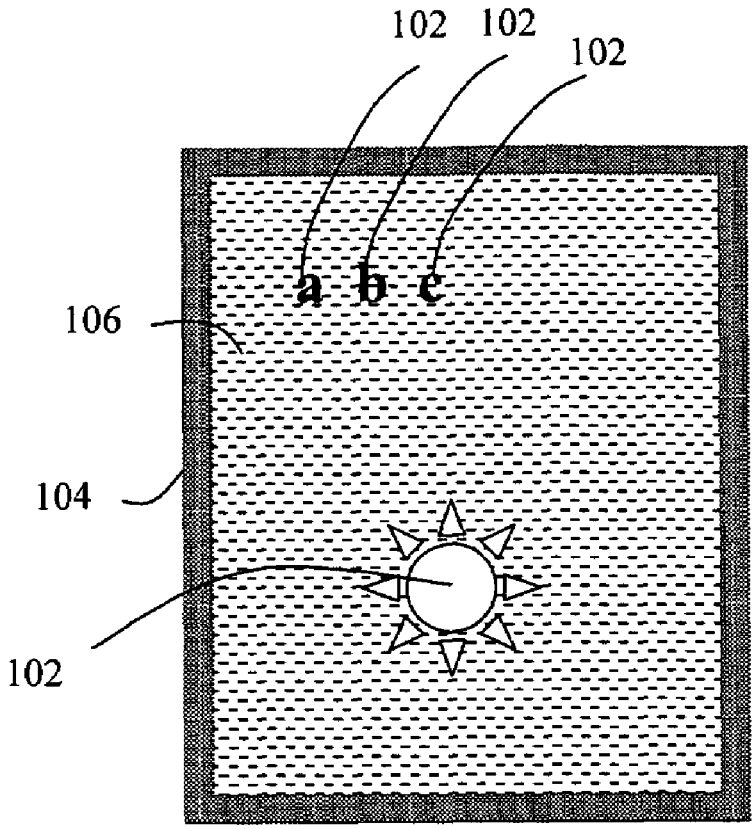
FIG. 8 is a top view of one example of an image plated onto a photoreceptor, where a transfer assist layer is applied initially to the entire imaging area.

The various figures for this invention illustrate a transfer assist layer that covers the same approximate area as the toner patch or toner layers. This is for representative purposes only, where actual applications may include toner layers and transfer assist layers of various thicknesses and coverage areas, even within a single imaging process. For example, FIG. 8 illustrates a photoreceptor 104 plated or generally covered with a transfer assist layer 106 that will contact the final receptor (not shown). This transfer assist layer may be applied as a "flood coating", for example, where the entire drum or photoreceptor is coated with the transfer assist material before the application of any toner images. This might be particularly useful if the transfer assist layer 106 is to end up on the surface of the printed image, such as to serve as a protective coating. The toner may then be applied in an imagewise manner on top of the transfer assist layer 106 in toner image areas 102 that have been discharged. Subsequently, both the toner in the image areas 102 and transfer assist layer 106 may be transferred to a final image receptor (not shown).

Figure 9A:
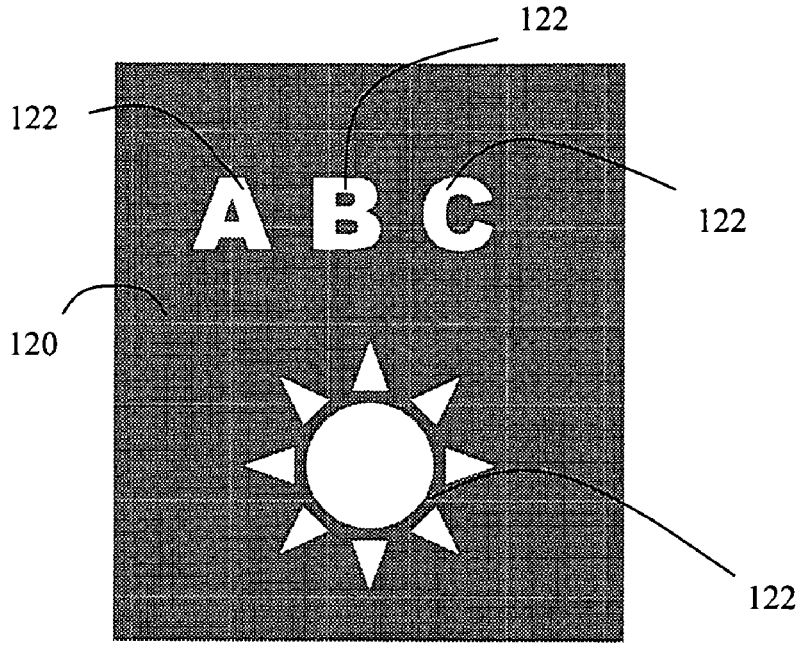
FIGS. 9*a* and 9*b* are top views of an image plated onto a photoreceptor, illustrating how the transfer assist layer is applied to only those areas that receive pigmented liquid toner.
Figure 9B:
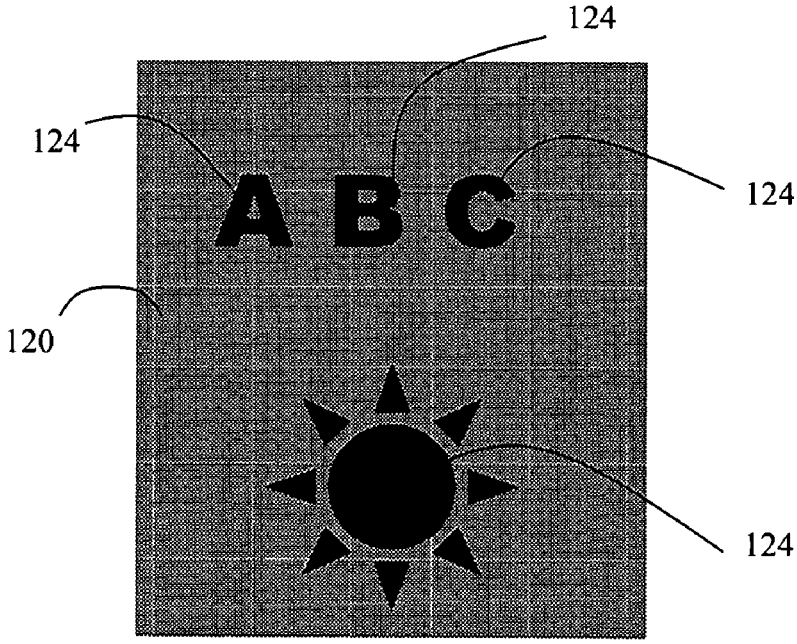

In some cases, it would be wasteful to apply the transfer assist material to background areas. As seen in FIG. 9*a*, the transfer assist material may be applied to a photoreceptor 120 in an imagewise manner in which the transfer assist particles deposit only on discharged image areas 122 that correspond to areas to which toner particles will subsequently be deposited, such that the areas surrounding these image areas 122 will be void of any applied transfer assist material. Toner images 124 made up of charged toner particles may then be formed over the transfer assist layer 122, as shown in FIG. 9*b*. In this manner there is a substantial superposition of the toner particles on the transfer material. This type of system might be most desired where the primary purpose of the transfer assist layer or material is to provide a release from the photoreceptor or the intermediate transfer member.

The operation of the present invention will be further described with regard to the following detailed examples. These examples are offered to further illustrate the various specific and preferred embodiments and techniques. It should be understood, however, that many variations and modifications might be made while remaining within the scope of the present invention.

EXAMPLES

Test Methods and Apparatus for Transfer Assist Material and Liquid Toner Preparation

Percent Solids

In the following toner composition examples, percent solids of the graft stabilizer solutions and the organosol and liquid toner dispersions were determined thermo-gravimetrically by drying in an aluminum weighing pan an originally-weighed sample at 160° C. for two hours for graft stabilizer and organosol and for three hours for liquid toners, weighing the dried sample, and calculating the percentage ratio of the dried sample weight to the original sample weight, after accounting for the weight of the aluminum weighing pan. Approximately two grams of sample were used in each determination of percent solids using this thermo-gravimetric method.

Molecular Weight

In the practice of the invention, molecular weight is normally expressed in terms of the weight average molecular weight, while molecular weight polydispersity is given by the ratio of the weight average molecular weight to the number average molecular weight. Molecular weight parameters were determined with gel permeation chromatography (GPC) using tetrahydrofuran as the carrier solvent. Absolute weight and average molecular weight were determined using a Dawn DSP-F light scattering detector (Wyatt Technology Corp., Santa Barbara, Calif.), while polydispersity was evaluated by ratioing the measured weight average molecular weight to a value of number average molecular weight determined with an Optilab 903 differential refractometer detector (Wyatt Technology Corp., Santa Barbara, Calif.).

Particle Size

Polymer and toner particle size distributions were determined using a Horiba LA-920 laser diffraction particle size analyzer (Horiba Instruments, Inc., Irvine, Calif.). Samples are diluted approximately 1/500 by volume in Norpar™ 12 and sonicated for one minute at 150 watts and 20 kHz prior to measurement. Particle size was expressed as both a number mean diameter ($D_n$) and a volume mean diameter ($D_v$) in order to provide an indication of both the fundamental (primary) particle size and the presence of aggregates or agglomerates.

Glass Transition Data

Thermal transition data for synthesized TM was collected using a TA Instruments Model 2929 Differential Scanning Calorimeter (New Castle, Del.) equipped with a DSC refrigerated cooling system (−70° C. minimum temperature limit), and dry helium and nitrogen exchange gases. The calorimeter ran on a Thermal Analyst 2100 workstation with version 8.10B software. An empty aluminium pan was used as the reference. The samples were prepared by placing 6.0 to 12.0 mg of the experimental material into an aluminum sample pan and crimping the upper lid to produce a hermetically sealed sample for DSC testing. The results were normalized on a per mass basis. Each sample was evaluated using 10° C./min heating and cooling rates with a 5-10 min isothermal bath at the end of each heating or cooling ramp. The experimental materials were heated five times: the first heat ramp removes the previous thermal history of the sample and replaces it with the 10° C./min cooling treatment and subsequent heat ramps are used to obtain a stable glass transition temperature value—values are reported from either the third or fourth heat ramp.

Conductivity

The liquid toner conductivity (bulk conductivity, $k_b$) was determined at approximately 18 Hz using a Scientifica Model 627 conductivity meter (Scientifica Instruments, Inc., Princeton, N.J.). In addition, the free (liquid dispersant) phase conductivity ($k_f$) in the absence of toner particles was also determined. Toner particles were removed from the liquid medium by centrifugation at 5° C. for 1-2 hours at 6,000 rpm (6,110 relative centrifugal force) in a Jouan MR1822 centrifuge (Winchester, Va.). The supernatant liquid was then carefully decanted, and the conductivity of this liquid was measured using a Scientifica Model 627 conductance meter. The percentage of free phase conductivity relative to the bulk toner conductivity was then determined as 100% ($k_f/k_b$).

Mobility

Toner particle electrophoretic mobility (dynamic mobility) was measured using a Matec MBS-8000 Electrokinetic Sonic Amplitude Analyzer (Matec Applied Sciences, Inc., Hopkinton, Mass.). Unlike electrokinetic measurements based upon microelectro-phoresis, the MBS-8000 instrument has the advantage of requiring no dilution of the toner sample in order to obtain the mobility value. Thus, it was possible to measure toner particle dynamic mobility at solids concentrations actually preferred in printing. The MBS-8000 measures the response of charged particles to high frequency (1.2 MHz) alternating (AC) electric fields. In a high frequency AC electric field, the relative motion between charged toner particles and the surrounding dispersion medium (including counterions) generates an ultrasonic wave at the same frequency of the applied electric field. The amplitude of this ultrasonic wave at 1.2 MHz can be measured using a piezoelectric quartz transducer; this electrokinetic sonic amplitude (ESA) is directly proportional to the low field AC electrophoretic mobility of the particles. The particle zeta potential can then be computed by the instrument from the measured dynamic mobility and the known toner particle size, liquid dispersant viscosity, and liquid dielectric constant.

Q/M

The charge per mass measurement (Q/M) was measured using an apparatus that consists of a conductive metal plate, a glass plate coated with Indium Tin Oxide (ITO), a high voltage power supply, an electrometer, and a personal computer (PC) for data acquisition. A 1% solution of ink was placed between the conductive plate and the ITO coated glass plate. An electrical potential of known polarity and magnitude was applied between the ITO coated glass plate and the metal plate, generating a current flow between the plates and through wires connected to the high voltage power supply. The electrical current was measured 100 times a second for 20 seconds and recorded using the PC. The applied potential causes the charged toner particles to migrate towards the plate (electrode) having opposite polarity to that of the charged toner particles. By controlling the polarity of the voltage applied to the ITO coated glass plate, the toner particles may be made to migrate to that plate.

The ITO coated glass plate was removed from the apparatus and placed in an oven for approximately 30 minutes at 50° C. to dry the plated ink completely. After drying, the ITO coated glass plate containing the dried ink film was weighed. The ink was then removed from the ITO coated glass plate using a cloth wipe impregnated with Norpar™ 12, and the clean ITO glass plate was weighed again. The difference in mass between the dry ink coated glass plate and the clean glass plate is taken as the mass of ink particles (m) deposited during the 20 second plating time. The electrical current values were used to obtain the total charge carried by the toner particles (Q) over the 20 seconds of plating time by integrating the area under a plot of current vs. time using a curve-fitting program (e.g. TableCurve 2D from Systat Software Inc.). The charge per mass (Q/m) was then determined by dividing the total charge carried by the toner particles by the dry plated ink mass.

Print Testing

The prints generated for the Examples were made on a prototype liquid electrophotographic printer configuration similar to the apparatus shown and described for FIG. 5*b*. To generate prints, three development units, shown in FIG. 5*b* as 4*a*, 4*b*, and 4*c* were filled with either liquid toner comprising charged toner particles or the liquid transfer assist material comprising charged particles. The exact contents of each development unit varied with each example and are explained more fully below.

For the development unit 4*a* the photoreceptive element 2 was charged to between 850V and 1000V, then discharged in an imagewise manner with laser light from a scanner driven in response to image data sent from a computerized controller to create a latent image on the surface of the photoreceptor. The charging and discharging apparatus are not shown. The charged liquid toner or transfer assist material in the development unit 4*a* was attracted to the discharged regions of the photoreceptive element 2 in toner development unit 4*a*, to form a toned image on the photoreceptor. The toned image on the photoreceptor was then rotated into position relative to the biased intermediate transfer member 14 (in this case, a belt), to which the charged toner particles were electrostatically transferred. The process was repeated for development units 4*b* and 4*c* so that the intermediate transfer member 14 received contributions to the total composite image layer from as many as four development units in these experiments in less than one complete rotation of the intermediate transfer member.

The intermediate transfer member 14 holding the composite image was further rotated in the direction of the arrow 18 to encounter a final image receptor 8. The final image receptor 8 was positioned between the charged composite on the intermediate transfer member 14 and a backup roller 10, biased to a polarity opposite that of the charged toner particles making up the composite image on the intermediate transfer member.

The biased backup roller 10 attracted the charged total toner layer particles to the final image receptor 8.

The resulting image was fixed to the final image receptor in a subsequent step using heat and pressure.

Fused Image Erasure Resistance:

This test is used to determine image durability when a printed image is subjected to abrasion from materials such as other paper, linen cloth, and pencil erasers.

In order to quantify the resistance of the printed ink to erasure forces after fusing, an erasure test has been defined. This erasure test consists of using a device called a Crockmeter to abrade the inked and fused areas with a linen cloth loaded against the ink with a known and controlled force. A standard test procedure followed generally by the inventors is defined in ASTM #F 1319-94 (American Standard Test Methods). The Crockmeter used in this testing was an AATCC Crockmeter Model CM1 manufactured by Atlas Electric Devices Company, Chicago, Ill. 60613.

For these tests, a rubber eraser from a standard pencil was used in place of the linen cloth. It is the opinion and experience of the inventors that, in printing technology, the most common abrasion a print will undergo is writing and erasing on the prints with a pencil. When a standard rubber eraser has been affixed onto the Crockmeter probe, the probe is placed onto the printed surface with a controlled force and caused to slew back and forth on the printed surface a prescribed number of times (in this case, 10 times by the turning of a small crank with 5 full turns at two slews per turn). The prepared samples are of sufficient length so that during the slewing, the erase head never leaves the printed surface by crossing the ink boundary and slewing onto the paper surface.

For this Crockmeter, the head weight was 934 grams, which is the weight placed on the ink during the 10-slew test, and the area of contact of the rubber eraser with the ink was 1.76 $cm^2$. The results of this test are obtained as described in the standard test method, by determining the optical density of the printed area before the abrasion and the optical density after the abrasion. The difference between the two numbers is divided by the original density and multiplied by 100% to obtain the percentage remaining.

Optical Density and Color Purity

To measure optical density and color purity a GRETAG SPM 50 LT meter was used. The meter is made by Gretag Limited, CH-8105 Regensdort, Switzerland. The meter has several different functions through different modes of operations, selected through different buttons and switches. When a function (optical density, for example) is selected, the measuring orifice of the meter is placed on a background, or non-imaged portion of the imaged substrate in order to "zero" it. It is then placed on the designated color patch and the measurement button is activated. The optical densities of the various color components of the color patch (in this case, Cyan (C), Magenta (M), Yellow (Y), and Black (K)) will then displayed on the screen of the meter. The value of each specific component is then used as the optical density for that component of the color patch. For instance, where a color patch is only cyan, the optical density reading may be listed as simply the value on the screen for C. Where the color patch is a combination of colors (such as Blue=Cyan+Magenta), the meter will read the optical density of the cyan that contributes to the blue patch and is expressed as C(B); that same patch would also have a magenta component, expressed as M(B).

To measure the color content of a color patch, the L*,a*,b*. (calorimetry) function of the meter is selected. The device is first "zeroed" by measuring a non-imaged area of the imaged substrate, then orifice is placed at the area of the color patch to be measured and the meter is activated. L*, a*, b* (CIELAB color coordinates) values of the color patch will then be displayed. The value of the L*,a*,b* test is determined as follows: "L*" defines lightness, "a*" denotes red/green value, and "b*" denotes the yellow/blue value. The color content of a color patch at a constant L is defined by a and b. One way of defining the color tint of a patch is by the ratio of b/a. Color purity of a color patch with a constant tint (b/a=constant) is proportional to the length of the vector defined by a and b (the "a" axis is horizontal, "b" is vertical) or the value of the square root of $a^2+b^2$. The color is said to be purer if the length of the vector becomes larger and the tint stays more or less the same, i.e. b/a does not change much.

Image Blocking Resistance

A humidity chamber (made by Thermotron Industries, Kellen Park Drive, Hollan, Mich.; model number SE-1200-5-5) is set according to the manufacturer's instructions at 58° C. and 75% relative humidity (RH) for this test. Samples for testing both adhesive (imaged portion against non-imaged portion) and cohesive (imaged portion against imaged portion) blocking are then prepared.

Cohesive blocking test: The samples are prepared by cutting printed pages into 1.25 in. squares (two printed squares are needed for each test). Plain, unprinted pages are also cut into 1.25 in. squares, two for each test. To arrange the samples for testing, two squares with printed ink on one side are placed face to face, with printed sides touching. Two squares of the plain, unprinted paper are placed, one on each (back)side of the first two squares. Multiple samples may be prepared in this way, with no more than four squares stacked per sample.

Adhesive blocking test: The samples are prepared by cutting printed pages into 1.25 in. squares (two printed squares are needed for each test). Plain, unprinted pages are also cut into 1.25 in. squares, two for each test. To arrange the samples for testing, two squares with printed ink on one side are placed front to back with one unprinted (plain paper) square, such that the printed side of one square faces one side of the unprinted (plain paper) square, and the printed side of the other printed square faces the back of the first printed square. The remaining unprinted square is placed against the back of the second printed square. Multiple samples may be prepared in this way, with no more than four squares stacked per sample.

Blocking Testing

Each set of samples is pre-treated for 24 hours in the humidity chamber with just a standard tongue depressor holding down each set of samples on a piece of glass. After the first 24 hours, a 1 pound weight, measuring 1 square inch is applied to the sample stack for another 24 hours. The samples are then removed, allowed to cool, and evaluated for any blocking tendencies based on pull apart sound and visible image transfer.

Materials

The following abbreviations are used in the compositions:

AIBN: Azobisisobutyronitrile (an initiator available as VAZO-64 from DuPont Chemical Co., Wilmington, Del.)

DBTDL: Dibutyl tin dilaurate (a catalyst available from Aldrich Chemical Co., Milwaukee, Wis.)

EA: Ethyl acrylate (available from Aldrich Chemical Co., Milwaukee, Wis.)

EHMA: 2-Ethylhexyl methacrylate (available from Aldrich Chemical Co., Milwaukee, Wis.)

EMA: Ethyl methacrylate (available from Aldrich Chemical Co., Milwaukee, Wis.)

HEMA: 2-Hydroxyethyl methacrylate (available from Aldrich Chemical Co., Milwaukee, Wis.)

LMA: Lauryl methacrylate (available from Aldrich Chemical Co., Milwaukee, Wis.)

MMA: Methyl methacrylate (available from Aldrich Chemical Co., Milwaukee, Wis.)

TMI: Dimethyl-m-isopropenyl benzyl isocyanate (available from CYTEC Industries, West Paterson, N.J.)

TCHMA: Trimethyl cyclohexyl methacrylate (available from Ciba Specialty Chemical Co., Suffolk, Va.)

Preparation of Transfer Assist Materials

1. Preparations of Copolymer Graft Stabilizers

TABLE 1

Graft Stabilizers for Transfer Assist Materials

| Graft Stabilizer Composition | Graft Stabilizer Compositions (% w/w) | Solids (%) | Molecular Weight $M_w$ | $M_w/M_n$ |
|---|---|---|---|---|
| 1.1 | EHMA/HEMA-TMI (97/3-4.7% w/w) | 26.17 | 201,500 | 3.3 |
| 1.2 | LMA/HEMA-TMI (97/3-4.7) | 25.64 | 223,540 | 3.0 |
| 1.3 | TCHMA/HEMA-TMI (97/3-4.7) | 28.86 | 301,000 | 3.3 |

Composition 1.1

A 2000 l reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. The reactor was allowed to cool to ambient temperature and put under a nitrogen blanket for 30 minutes. The reactor was charged with 274.5 Kg of Norpar™ 12. 0.60 Kg of AIBN was then added. Next 97.0 Kg of EHMA and 3.09 Kg of 98% HEMA was added along with 20 Kg of Norpar™ 12. A full vacuum was then applied with nitrogen. A second vacuum was pulled. The vacuum was then broken with a nitrogen blanket and a light flow of nitrogen of 0.1 barg was applied. Agitation was at 70 RPM and the mixture was heated to 70° C. and held for 16 hours. The conversion was quantitative.

The mixture was heated to 90° C. and held at that temperature for 1 hour to destroy any residual AIBN, and then was cooled back to 70° C. The nitrogen inlet tube was then removed, and 1.55 Kg of 95% DBTDL was added to the mixture dropwise over the course of 5 minutes, followed by the addition 4.70 Kg of TMI. The TMI was added drop wise over the course of approximately 15 minutes while stirring the reaction mixture. The mixture was allowed to react at 70° C. for 6 hours, at which time the conversion was quantitative.

The mixture was then cooled to room temperature. The cooled mixture was a viscous, transparent liquid containing no visible insoluble matter. The percent solids of the liquid mixture were determined to be 26.2% using the Thermogravimetric method described above. Subsequent determination of molecular weight was made using the GPC method described above; the copolymer had a $M_w$ of approximately 234,000 and $M_w/M_n$ of 2.0 based on two independent measurements. The product is a copolymer of EHMA and HEMA with a TMI grafting site and is designed herein as EHMA/HEMA-TMI (97/3-4.7% w/w) and can be used to make an organosol.

Composition 1.2

Using the method and apparatus of Composition 1.1, 2561 g of Norpar™ 12, 849 g of LMA, 26.8 g of 98% HEMA and 8.31 g of AIBN were combined and the resulting mixture was reacted at 70° C. for 16 hours. The mixture was then heated to 90° C. for 1 hour to destroy any residual AIBN, and then was cooled back to 70° C. To the cooled mixture was then added 13.6 g of 95% DBTDL and 41.1 g of TMI. The TMI was added drop wise over the course of approximately 5 minutes while stirring the reaction mixture. Following the procedure of Composition 1.1, the mixture was reacted at 70° C. for approximately 6 hours at which time the reaction was quantitative. The mixture was then cooled to room temperature. The cooled mixture was viscous, transparent solution, containing no visible insoluble mater.

The percent solids of the liquid mixture was determined to be 25.64% using the thermogravimetric method described above. Subsequent determination of molecular weight was made using the GPC method described above; the copolymer had a $M_w$ of 223,540 Da and $M_w/M_n$ of 3.0 based upon two independent measurements. The product is a copolymer of LMA and HEMA with a TMI grafting site and is designed herein as LMA/HEMA-TMI (97/3-4.7% w/w) and is suitable for making an organosol.

Composition 1.3

Using the method and apparatus of Composition 1.1, 2561 g of Norpar™ 12, 849 g of TCHMA, 26.8 g of 98% HEMA and 8.31 g of AIBN were combined and the resulting mixture was reacted at 70° C. for 16 hours. The mixture was then heated to 90° C. for 1 hour to destroy any residual AIBN, and then was cooled back to 70° C. To the cooled mixture was then added 13.6 g of 95% DBTDL and 41.1 g of TMI. The TMI was added drop wise over the course of approximately 5 minutes while stirring the reaction mixture. Following the procedure of Composition 1.1, the mixture was reacted at 70° C. for approximately 6 hours at which time the reaction was quantitative. The mixture was then cooled to room temperature. The cooled mixture was viscous, transparent solution, containing no visible insoluble mater.

The percent solids of the liquid mixture was determined to be 28.86% using the thermogravimetric method described above. Subsequent determination of molecular weight was made using the GPC method described above; the copolymer had a $M_w$ of 301,000 Da and $M_w/M_n$ of 3.3 based upon two independent measurements. The product is a copolymer of TCHMA and HEMA with a TMI grafting site and is designed herein as TCHMA/HEMA-TMI (97/3-4.7% w/w) and is suitable for making an organosol.

2. Preparations of Organosols

TABLE 2

Organosols for Transfer Assist Materials

| Organosol Compositions | Organosol Compositions (% w/w) | $D_v$ (μm) | Tg (° C.) |
|---|---|---|---|
| 2.1 | EHMA/HEMA-TMI//MMA/EA (97/3-4.7//25/75) | 8.24 | −1 |
| 2.2 | LMA/HEMA-TMI//EMA/EA (97/3-4.7//68/32) | 0.36 | 30 |
| 2.3 | TCHMA/HEMA-TMI//EMA (97/3-4.7//100) | 24.3 | 65 |
| 2.4 | LMA/HEMA-TMI//EMA (97/3-4.7//100) | 8.5 | 65 |

Composition 2.1

This is an example using the graft stabilizer prepared in Composition 1.1 to prepare an organosol with a core $T_g$ of −1° C. A 2000 l reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 120° C. A vacuum was applied and the reactor was allowed to cool to ambient temperature. The reactor was charged with a mixture of 16.0 Kg of the graft stabilizer mixture in Composition 1.1 @ 26.2% polymer solids and 988 Kg of Norpar™ 12. Agitation was then turned on at a rate of 70 RPM. Next 2.52 Kg of AIBN was added. Then 96.0 Kg of EA and 32.0 Kg of MMA were added along with 20 Kg Norpar™ 12. A full vacuum was then applied for 10 minutes under nitrogen. A second vacuum was pulled for 10 minutes. The vacuum was then broken with a nitrogen blanket and a light flow of nitrogen of 0.1 barg was applied. The temperature of the reactor was heated to 70° C. and maintained for 16 hours. The conversion was quantitative.

120 Kg of n-heptane was added to the cooled organosol. The resulting mixture was stripped of residual monomer. Agitation was increased to 90 RPM and the batch heated to 95° C. The nitrogen flow was stopped and a vacuum of 125 torr was pulled and held for 10 minutes. The vacuum was then increased to 80, 50, and 30 torr. The vacuum was increased to 20 torr and held for 20 minutes. At that point a full vacuum was until the residual monomer is stripped. The vacuum was then broken, and the stripped organosol was cooled to room temperature, yielding an opaque white dispersion.

This organosol is designed EHMA/HEMA-TMI//MMA/EA (97/3-4.7//25/75% w/w). The percent solid of the organosol dispersion after stripping was determined as 19.38% using Thermogravimetric method described above. Subsequent determination of average particles size was made using the light scattering method described above; the organosol had a volume average diameter of 0.226 μm.

Composition 2.2

This example illustrates the use of the graft stabilizer prepared in Composition 1.2 to prepare an organosol with a core $T_g$ of 30° C. Using the method and apparatus of Composition 2.1, 2940 g of Norpar™ 12, 120.7 g of EA, 252.7 g of EMA, 182.0 g of the graft stabilizer mixture from Composition 1.2 @ 25.64% polymer solids, and 4.20 g of AIBN were combined. The mixture was heated to 70° C. for 16 hours. The conversion was quantitative. The mixture then was cooled to room temperature. After stripping the organosol using the method of Composition 2.1 to remove residual monomer, the stripped organosol was cooled to room temperature, yielding an opaque white dispersion. This organosol is designed LMA/HEMA-TMI//EMA/EA (97/3-4.7//68/32% w/w). The percent solids of the organosol dispersion after stripping was determined as 16.20% using the thermogravimetric method described above. Subsequent determination of average particles size was made using the laser diffraction particle size analyzer described above; the organosol had a volume average diameter of 0.36 μm.

Composition 2.3

This example illustrates the use of the graft stabilizer prepared in Composition 1.3 to prepare an organosol with a core $T_g$ of 65° C. Using the method and apparatus of Composition 2.1, 2943 g of Norpar™ 12, 373 g of EMA, 180 g of the graft stabilizer mixture from Composition 1.3 @ 28.86% polymer solids, and 4.20 g of AIBN were combined. The mixture was heated to 70° C. for 16 hours. The conversion was quantitative. The mixture then was cooled to room temperature. After stripping the organosol using the method of Composition 2.1 to remove residual monomer, the stripped organosol was cooled to room temperature, yielding an opaque white dispersion. This organosol is designed TCHMA/EMA-TMI//EMA (97/3-4.7//100% w/w).

The percent solids of the organosol dispersion after stripping was determined as 14.83% using the thermogravimetric method described above. Subsequent determination of average particles size was made using the laser diffraction particle size analyzer described above; the organosol had a volume average diameter of 24.3 μm.

Composition 2.4

This composition illustrates the use of the graft stabilizer in Composition 1.2 to prepare an organosol with a core $T_g$ of 65° C. Using the method and apparatus of Composition 2.1, 2940 g of Norpar™ 12, 373 g of EMA, 182 g of the graft stabilizer mixture from Composition 1.2 @ 25.64% polymer solids, and 4.20 g of AIBN were combined. The mixture was heated to 70° C. for 16 hours. The conversion was quantitative. The mixture then was cooled to room temperature. After stripping the organosol using the method of Composition 2.1 to remove residual monomer, the stripped organosol was cooled to room temperature, yielding an opaque white dispersion. This organosol is designed LMA/HEMA-TMI//EMA (97/3-4.7//100% w/w).

The percent solids of the organosol dispersion after stripping was determined to be 16.81% using the thermogravimetric method described above. Subsequent determination of average particles size was made using the laser diffraction particle size analyzer described above; the organosol had a volume average diameter of 8.5 μm.

3. Preparation of Charged Transfer Assist Particles

Composition 3.1

This is a composition of preparing a charged electrophotographic organosol with a core $T_g$ of −1° C. using the organosol prepared at core/shell of 8 in composition 2.1. 399 g of the organosol @ 15.03% (w/w) solids in Norpar™ 12 were combined with 351 g of Norpar™ 12, and 10.15 g of 5.91% Zirconium HEX-CEM solution (OMG Chemical Company, Cleveland, Ohio). This mixture was put on a shaker for 24 hours.

An 8% (w/w) solids charged organosol exhibited the following properties as determined using the test methods described above:

Volume Mean Particle Size: 8.24 microns
Q/M: 569 μC/g
Bulk Conductivity: 446 picoMhos/cm
Percent Free Phase Conductivity: 6.0%
Dynamic Mobility: 6.42E-11 ($m^2$/Vsec).

Composition 3.2

This is a composition of preparing a charged electrophotographic organosol with a core $T_g$ of 30° C. using the organosol prepared at core/shell of 8 in composition 2.2. 370 g of the organosol @ 16.20% (w/w) solids in Norpar™ 12 were combined with 380 g of Norpar™ 12, and 10.15 g of 5.91% Zirconium HEX-CEM solution (OMG Chemical Company, Cleveland, Ohio). This mixture was put on a shaker for 24 hours.

An 8% (w/w) solids charged organosol exhibited the following properties as determined using the test methods described above:

Volume Mean Particle Size: 0.36 micron
Q/M: 490 μC/g
Bulk Conductivity: 377 picoMhos/cm
Percent Free Phase Conductivity: 10.3%
Dynamic Mobility: 4.92E-11 ($m^2$/Vsec).

Composition 3.3

This is a composition of preparing a charged electrophotographic organosol with a core $T_g$ of 65° C. using the organosol prepared at core/shell of 8 in composition 2.3. 405 g of the organosol @ 14.83% (w/w) solids in Norpar™ 12 were combined with 345 g of Norpar™ 12, and 10.15 g of 5.91% Zirconium HEX-CEM solution (OMG Chemical Company, Cleveland, Ohio). This mixture was put on a shaker for 24 hours.

An 8% (w/w) solids charged organosol exhibited the following properties as determined using the test methods described above:

Volume Mean Particle Size: 24.3 microns
Q/M: 88 μC/g
Bulk Conductivity: 19.8 picoMhos/cm
Percent Free Phase Conductivity: 15.9%
Dynamic Mobility: 1.31E-11 ($m^2$/Vsec).

Composition 3.4

This is a composition of preparing a charged electrophotographic organosol with a core $T_g$ of 65° C. using the organosol prepared at core/shell of 8 in composition 2.4. 357 g of the organosol @ 16.81% (w/w) solids in Norpar™ 12 were combined with 393 g of Norpar™ 12, and 10.15 g of 5.91% Zirconium HEX-CEM solution (OMG Chemical Company, Cleveland, Ohio). This mixture was put on a shaker for 24 hours.

An 8% (w/w) solids charged organosol exhibited the following properties as determined using the test methods described above:

Volume Mean Particle Size: 8.5 microns
Q/M: 271 μC/g
Bulk Conductivity: 44 picoMhos/cm
Percent Free Phase Conductivity: 28.9%
Dynamic Mobility: 4.46E-11 ($m^2$/Vsec).

Preparation of Liquid Toners

4. Preparations of Copolymer Graft Stabilizers for Liquid Inks

TABLE 3

Graft Stabilizers

| Graft Stabilizer Composition | Graft Stabilizer Compositions (% w/w) | Solids (%) | Molecular Weight $M_w$ | Molecular Weight $M_w/M_n$ |
|---|---|---|---|---|
| 4.1 | TCHMA/HEMA-TMI (97/3-4.7) | 25.7% | 276,950 | 3.15 |
| 4.2 | TCHMA/HEMA-TMI (97/3-4.7) | 25.4% | 299,100 | 2.62 |

Composition 4.1

A 50 gallon reactor equipped with a condenser, a thermocouple connected to a digital temperature controller, a nitrogen inlet tube connected to a source of dry nitrogen and a mixer, was charged with a mixture of 199.88 lb of Norpar™ 12, 66.4 lb of TCHMA, 2.10 lb of 98% HEMA and 0.86 lb of V-601. While stirring the mixture, the reactor was purged with dry nitrogen for 30 minutes at flow rate of approximately 2 liters/minute, and the nitrogen flow rate was reduced to approximately 0.5 liters/min. The mixture was heated to 75° C. for 4 hours. The conversion was quantitative.

The mixture was heated to 100° C. and held at that temperature for 1 hour to destroy any residual V-601, and then was cooled back to 70° C. The nitrogen inlet tube was then removed, and 0.11 lb of 95% DBTDL was added to the mixture, followed by 3.23 lb of TMI. The TMI was added drop wise over the course of approximately 5 minutes while stirring the reaction mixture. The mixture was allowed to react at 70° C. for 2 hours, at which time the conversion was quantitative.

The mixture was then cooled to room temperature. The cooled mixture was a viscous, transparent liquid containing no visible insoluble mater. The percent solids of the liquid mixture was determined to be 25.7% using the thermogravimetric method described above. Subsequent determination of molecular weight was made using the GPC method described above; the copolymer had a $M_w$ of 276,950 and $M_w/M_n$ of 3.15 based on two independent measurements. The product is a copolymer of TCHMA and HEMA with a TMI grafting site and is designed herein as TCHMA/EMA-TMI (97/3-4.7% w/w) and can be used to make an organosol.

Composition 4.2

A graft stabilizer was prepared using the same materials, method and procedure as in Composition 4.1. The percent solids of the graft stabilizer was determined to be 25.4% using the thermogravimetric method described above. Subsequent determination of molecular weight was made using the GPC method described above; the copolymer had a $M_w$ of 299,100 and $M_w/M_n$ of 2.62 based on two independent measurements. The product is a copolymer of TCHMA and HEMA with a TMI grafting site and is designed herein as TCHMA/HEMA-TMI (97/3-4.7% w/w) and can be used to make an organosol.

5. Preparations of Organosols

TABLE 4

Organosols for Liquid Toner

| Organosol Composition Numbers | Organosol Compositions (% w/w) | Avg Particle Size (μm) | Measured $T_g$ (° C.) |
|---|---|---|---|
| 5.1 | TCHMA/HEMA-TMI//EMA/EA (97/3-4.7//87/13) | 45.2 | 45.9 |
| 5.2 | TCHMA/HEMA-TMI//EMA (97/3-4.7//100) | 25.4 | 75.3 |
| 5.3 | TCHMA/HEMA-TMI//EMA (97/3-4.7//100) | 42.3 | 62.7 |

Composition 5.1

A 560 gallon reactor equipped with a condenser, a thermocouple connected to a digital temperature controller, a nitrogen inlet tube connected to a source of dry nitrogen and a mixer, was charged with a mixture of 1598.5 lb of Norpar™ 12, 176 lb of EMA, 26.4 g of EA, 98.6 lb of the graft stabilizer mixture prepared from Composition 4.1 @ 25.7% polymer solids, and 2.05 lb of V-601. While stirring the mixture, the reactor was purged with dry nitrogen for 30 minutes at flow rate of approximately 2 liters/minute, and then the nitrogen flow rate was reduced to approximately 0.5 liters/min. The mixture was heated to 70° C. for 5 hours. The conversion was quantitative.

Approximately 290 lb of n-heptane were added to the cooled organosol, and the resulting mixture was stripped of residual monomer using a rotary evaporator equipped with a dry ice/acetone condenser and operating at a temperature of 90° C. and a vacuum of approximately 15 mm Hg. The stripped organosol was cooled to room temperature, yielding an opaque white dispersion.

This organosol is designed TCHMA/HEMA-TMI//EMA/EA (97/3-4.7//87/13% w/w). The percent solids of the organosol dispersion after stripping was determined as 13.68% using the thermogravimetric method described above. Subsequent determination of average particles size was made using the laser diffraction particle size analyzer described above; the organosol had a volume average diameter of 45.2 μm. The glass transition temperature was measured using DSC, as described above. The organosol particles had a $T_g$ of 45.9° C.

Composition 5.2

An organosol was prepared using the same method, materials, and procedures as in Composition 5.1, using graft stabilizer composition 4.1. This organosol is designed TCHMA/HEMA-TMI//EMA (97/3-4.7//100% w/w). The percent solids of the organosol dispersion after stripping was determined as 13.30% using the thermogravimetric method described above. Subsequent determination of average particles size was made using the laser diffraction particle size analyzer described above; the organosol had a volume average diameter of 25.4 μm. The glass transition temperature was measured using DSC, as described above. The organosol particles had a $T_g$ of 75.3° C.

Composition 5.3

An organosol was prepared using the same method and procedure in for Composition 5.1 with the graft stabilizer from Composition 4.2. The resulting organosol is designed TCHMA/HEMA-TMI//EMA (97/3-4.7//100% w/w). The percent solids of the organosol dispersion after stripping was determined as 13.10% using the thermogravimetric method described above. Subsequent determination of average particles size was made using the laser diffraction particle size analyzer described above; the organosol had a volume average diameter of 42.3 μm. The glass transition temperature was measured using DSC, as described above. The organosol particles had a $T_g$ of 62.7° C.

6. Preparation of Liquid Toners

Magenta Composition 1

2001 g of organosol (from Composition 5.1) @ 13.68% (w/w) solids in Norpar™ 12 was combined with 158 g of Norpar™ 12, 23.8 g of Pigment FR4580, 10.2 g of Pigment RA1087 (Clariant Corporation, Coventry, R.I.), and 6.41 g of 26.70% Zirconium HEX-CEM solution (OMG Chemical Company, Cleveland, Ohio). This mixture was then milled in a 0.25 gallon Hockmeyer mill (Model HSD Mill, Hockmeyer Equipment Corp. Elizabeth City, N.C.) charged with 472.6 g of 0.8 mm diameter Yttrium Stabilized Ceramic Media. The mill was operated at 2000 RPM for 60 minutes with water circulating through the jacket of the milling chamber at 45° C.

A 14% (w/w) solids toner concentrate exhibited the following properties as determined using the test methods described above:

Volume Mean Particle Size: 2.9 microns
Q/M: 199 μC/g
Bulk Conductivity: 240 picoMhos/cm
Percent Free Phase Conductivity: 2.21%
Dynamic Mobility: 5.53E-11 ($m^2$/Vsec)

Cyan Composition 1

2059 g of organosol (from Composition 5.1) @ 13.60% (w/w) solids in Norpar™ 12 was combined with 111 g of Norpar™ 12, 28 g of Pigment Blue 15:4 (Sun Chemical Company, Cincinnati, Ohio), and 2.10 g of 26.70% Zirconium HEX-CEM solution (OMG Chemical Company, Cleveland, Ohio). This mixture was then milled in a 0.25 gallon Hockmeyer mill (Model HSD Mill, Hockmeyer Equipment Corp. Elizabeth City, N.C.) charged with 472.6 g of 0.8 mm diameter Yttrium Stabilized Ceramic Media. The mill was operated at 2000 RPM for 60 minutes with water circulating through the jacket of the milling chamber at 45° C.

A 14% (w/w) solids toner concentrate exhibited the following properties as determined using the test methods described above:

Volume Mean Particle Size: 2.9 micron
Q/M: 191 μC/g
Bulk Conductivity: 204 picoMhos/cm
Percent Free Phase Conductivity: 0.84%
Dynamic Mobility: 6.02E-11 ($m^2$/Vsec)

Cyan Composition 2

1843 g of organosol (from Composition 5.2) @ 13.30% (w/w) solids in Norpar™ 12 was combined with 314 g of Norpar™ 12, 41 g of Pigment Blue 15:2 (Sun Chemical Company, Cincinnati, Ohio), and 1.53 g of 26.65% Zirconium HEX-CEM solution (OMG Chemical Company, Cleveland, Ohio). This mixture was then milled in a 0.25 gallon Hockmeyer mill (Model HSD Mill, Hockmeyer Equipment Corp. Elizabeth City, N.C.) charged with 472.6 g of 0.8 mm diameter Yttrium Stabilized Ceramic Media. The mill was operated at 2000 RPM for 60 minutes with water circulating through the jacket of the milling chamber at 45° C.

A 13% (w/w) solids toner concentrate exhibited the following properties as determined using the test methods described above:

Volume Mean Particle Size: 2.7 microns
Q/M: 162 μC/g
Bulk Conductivity: 126 picoMhos/cm
Percent Free Phase Conductivity: 0.86%
Dynamic Mobility: 3.01 E-11 ($m^2$/Vsec)

Magenta Composition 2

13025 g of organosol (from Composition 5.3) @ 13.10% (w/w) solids in Norpar™ 12 was combined with 1677 g of Norpar™ 12, 146.8 g of Pigment FR4580, 48.8 g of Pigment PR269, 48.8 g of Pigment Red 81:4 (Clariant Corporation, Coventry, R.I.), and 54.88 g of 26.65% Zirconium HEX-CEM solution (OMG Chemical Company, Cleveland, Ohio). This mixture was then milled in one gallon Hockmeyer mill (Model HSD Mill, Hockmeyer Equipment Corp. Elizabeth City, N.C.) charged with 4175 g of 0.8 mm diameter Yttrium Stabilized Ceramic Media. The mill was operated at 2000 RPM for 60 minutes with water circulating through the jacket of the milling chamber at 45° C.

A 13% (w/w) solids toner concentrate exhibited the following properties as determined using the test methods described above:

Volume Mean Particle Size: 2.5 micron
Q/M: 292 μC/g
Bulk Conductivity: 337 picoMhos/cm
Percent Free Phase Conductivity: 2.27%
Dynamic Mobility: 4.91E-11 ($m^2$/Vsec)

Cyan Composition 3

12759 g of organosol (from Composition 5.3) @ 13.10% (w/w) solids in Norpar™ 12 was combined with 1947 g of Norpar™ 12, 279 g of Pigment Blue 15:2 (Sun Chemical Company, Cincinnati, Ohio), and 15.68 g of 26.65% Zirconium HEX-CEM solution (OMG Chemical Company, Cleveland, Ohio). This mixture was then milled in one gallon Hockmeyer mill (Model HSD Mill, Hockmeyer Equipment Corp. Elizabeth City, N.C.) charged with 4175 g of 0.8 mm diameter Yttrium Stabilized Ceramic Media. The mill was operated at 2000 RPM for 60 minutes with water circulating through the jacket of the milling chamber at 80° C.

A 14% (w/w) solids toner concentrate exhibited the following properties as determined using the test methods described above:

Volume Mean Particle Size: 2.7 microns
Q/M: 212 μC/g
Bulk Conductivity: 226 picoMhos/cm
Percent Free Phase Conductivity: 1.12%
Dynamic Mobility: 6.09E-11 ($m^2$/Vsec)

Example 1

Using the printing method described above (background and detailed description) and the apparatus as described above, the transfer assist material described as Composition 3.1 was placed in the development unit in the first position (development unit 4*a* of FIG. 5*b*). Development units in the second and third positions were filled with cyan liquid ink described as Cyan Composition 1 (development unit 4*b* of FIG. 5*b*) and magenta liquid ink described as Magenta Composition 1 (development unit 4*c* of FIG. 5*b*), respectively. In the printing process for this Example, the liquid transfer assist layer was imagewise electrostatically transferred to the intermediate transfer member in a three bar pattern, followed by the imagewise electrostatic transfer of cyan on top of two transfer assist layer bars. The magenta ink was electrostatically transferred over the transfer assist layer on the remaining bar and was also transferred over one of the bars having both the transfer assist material and cyan, the combination creating a blue bar. The same process was repeated for a second print without the use of the development unit containing the transfer assist material (4*a* of FIG. 5*b*), so that only the pigmented ink layers were applied. Both sets of prints were fused in a four roller fuser system, with all four rollers set at 120° C.

Results

The resulting images were analyzed both visually and with the spectrophotometer described previously. The visual results upon comparing images made with and without the transfer assist material showed that the images made with the transfer assist material had significantly fewer "microvoids" or tiny voids where the toner did not completely cover the paper. The microvoids produce a substandard image because the color appears to be "interrupted."

The spectrophotometer was then set to provide the L*,a*, b* reading for color purity. The results are shown in Table 5 below.

TABLE 5

| Color bar | L* | a* | b* |
|---|---|---|---|
| Magenta only | 54.56 | 73.93 | −0.86 |
| Magenta with transfer assist layer | 54.64 | 73.79 | −0.98 |
| Cyan only | 55 | −20.92 | −50.27 |
| Cyan with transfer assist layer | 51.33 | −25.06 | −53.93 |

The spectrophotometer was also set to provide optical density readings for the images. Table 6 shows the results. Because cyan has been noted to have more problems with microvoids than magenta, the results are significant, particularly with respect to cyan.

TABLE 6

Optical Density on the solid patch

| Color bar | Optical Density |
|---|---|
| Magenta only | 1.159 |
| Magenta with transfer assist layer | 1.153 |
| Cyan only | 1.043 |
| Cyan with transfer assist layer | 1.273 |

Both sets of printed pages were also subjected to durability testing. The fuser set point for all four rollers as discussed above was 120° C., a relatively low fusing set point. Erasure and blocking tests were run as described above. The results of the erasure test are shown below in Table 7.

TABLE 7

Four-roller fuser set point: All four set at 120° C.

| Color Bar | $OD^1$ | $OD^2$ |
|---|---|---|
| Cyan only | 1.018 | 1.001 |
| Cyan with transfer assist layer | 1.234 | 1.265 |
| Magenta only | 1.185 | 1.132 |
| Magenta with transfer assist layer | 1.275 | 1.268 |
| Cyan component of the Blue bar | 1.413 | 1.261 |
| Cyan component of the Blue bar (with transfer assist layer) | 1.475 | 1.552 |
| Magenta component of the Blue bar | 1.435 | 1.299 |
| Magenta component of the Blue bar (with transfer assist layer) | 1.409 | 1.47 |

$OD^1$ = Optical density of the printed ink bar on paper in the area to be abraded before abrasion with a crockmeter.
$OD^2$ = Optical density of the printed ink bar in the abraded area after abrasion.

In Table 7, for all cases where no transfer assist material was used, the crockmeter was able to diminish the print quality or optical density of the printed image. In every case where the transfer assist layer was used, the print quality and abrasion resistance was improved. In cases where the optical density was actually improved over the original density, it is commonly believed that the rubbing of the eraser on a durable image can create a gloss effect that will enhance the spectrophotometer's perception of the print density due to increased light reflection.

Blocking tests were also ordered for this set of prints because the Transfer Assist Material (Composition 3.1) was made to have a low (−1° C.) $T_g$. This tends to create a sticky material and the inventors wanted to be sure that the stickiness would not affect final print quality. The blocking test was run as described above and all samples passed. There appears to be enough of the higher $T_g$ ink over the transfer assist material to discourage blocking.

Example 2

The same test as in Example 1 was repeated for Example 2, except the four roller fuser temperature was set so that the first pair of rollers that a print encountered were each set at 155° C., and the second pair were each set at 185° C. The purpose of this experiment was to observe the effects of higher temperature fusing on prints utilizing the transfer assist layer. Specifically, the inventors were looking for hot offset, a problem where, the fuser roller temperatures are so hot, that as the toner melts into the paper, it actually is induced to melt or adhere to the very hot roller in some spots. As the paper passes through the fusing apparatus, the toner that is stuck to the fusing roller may be deposited back to the paper on a later revolution of the fusing roller (causing the toner from one area to be "offset" to another), or the toner may remain adhered to the fusing roller causing more undesirable image artifacts.

Prints were generated as for Example 1, with bars of the same formulation of cyan, magenta, and blue being created. Another set of prints was generated having a layer of the transfer assist material (Composition 3.1) as described in Example 1. As the prints from each set were made and fused, the inventors observed hot fuser offset of the Blue bar in the prints without the transfer assist material. As the prints with the transfer assist material were made and fused, the inventors noted no hot fuser offset.

Example 3

Using the printing method described above (background and detailed description) and the apparatus as described above, the transfer assist material described as Composition 3.1 was placed in the development unit in the first position (development unit 4*a* of FIG. 5*b*). Development units in the second and third positions were filled with cyan liquid ink described as Cyan Composition 1 (development unit 4*b* of FIG. 5*b*) and magenta liquid ink described as Magenta Composition 1 (development unit 4*c* of FIG. 5*b*), respectively. In the printing process for this Example, a three bar pattern was electrostatically printed on the intermediate transfer member by the individual development unit (4*a*-4*c* of FIG. 5*b*), such that the transfer assist material from the first position (development unit 4*a* of FIG. 5*b*) printed all three bars, then the first bar on the intermediate transfer member was overprinted with cyan (development unit 4*b* of FIG. 5*b*), the second was overprinted first with cyan and then with magenta (consecutive development units 4*b* and 4*c* of FIG. 5*b*), and the third was printed just with magenta (development unit 4*c* of FIG. 5*b*). Multiple prints were created in this way. The same process was repeated for a second set of prints without the use of the development unit containing the transfer assist material (4*a* of FIG. 5*b*), so that only the pigmented ink layers were applied. Both sets of prints were fused in a four roller fuser system, with the two pairs of rollers set at varying set points. The temperature for the first pair of rollers varied from 100° C.-170° C., and the set points of the second pair varied from 120° C.-190° C.

Results

As shown in Table 8, below, the results for Example 3, sets 1 and 2 show that the use of this transfer assist layer formulation over the pigmented toner on the intermediate transfer member was unsuccessful. For any given pair of fuser set points, the printed ink on the paper was offset. The use of a low Tg (−1° C.) transfer assist material where the transfer assist material is in direct contact with the hot fuser rollers causes the sticky transfer assist material to transfer off onto the rollers, taking the ink with it. The results of EXAMPLES 1-3, are found in Table 8 below.

Example 4

Using the printing method described above (background and detailed description) and the apparatus as described above, the transfer assist material described as Composition 3.3 was placed in the development unit in the third position (development unit 4*c* of FIG. 5*b*). Development units in the first and second positions were filled with cyan liquid ink described as Cyan Composition 2 (development unit 4*a* of FIG. 5*b*) and magenta liquid ink described as Magenta Composition 2 (development unit 4*b* of FIG. 5*b*), respectively. In the printing process for this Example, a three bar pattern was printed, such that the first bar on the intermediate transfer member was cyan (development unit 4*a* of FIG. 5*b*), the second was printed first with cyan and then with magenta (consequtive development units 4*a* and 4*b* of FIG. 5*b*), and the third was printed just with magenta (development unit 4*b* of FIG. 5*b*). The liquid transfer assist layer (development unit 4*c* of FIG. 5*b*) was imagewise electrostatically transferred to the intermediate transfer member in a three bar pattern, over each of the three pigmented bars. Multiple prints were created in this way. The same process was repeated for a second set of prints without the use of the development unit containing the transfer assist material (4*c* of FIG. 5*b*), so that only the pigmented ink layers were applied. Both sets of prints were fused in a four roller fuser system, with the first pair of rollers set at 140° C., and the second pair set at 150° C. Although two colors were applied, as described in Example 1, the only measurements taken were for the cyan bars because the magenta and blue bars generally had fewer transfer problems and better optical densities.

Results

As shown in Table 9, following Example 5, the results for Example 4, sets 1 and 2 show that the use of this transfer assist layer formulation over the pigmented toner on the intermediate transfer member enhances the optical quality of the final image on the paper by contacting the paper. One reason for this is that the additional, clear transfer assist layer helps to create a thicker toner layer, promoting absorption into the relatively rough areas of the paper. Another reason may be that the transfer assist layer serves to act as a sort of "glue" holding the pigmented ink layer to the paper. Optical quality

TABLE 8

| Example | Inks Used | Transfer Assist Composition | Transfer Assist Material Applied Over or Under Pigmented Ink on ITM | Color bar on paper | Measured Optical Density |
|---|---|---|---|---|---|
| #1, Set 1 | Cyan composition 1 | 3.1 | Over (transfer layer contacts paper) | Cyan only | 1.08 |
| #1, Set 2 | | | | Cyan bar with transfer assist material under it | 1.26 |
| #2, Set 1 | Cyan composition 1 | 3.1 | Over (transfer layer contacts paper) | Blue only | No result - fuser offset |
| #2, Set 2 | | | | Blue bar with transfer assist material under it | No result - fuser offset |
| #3, Set 1 | Cyan composition 1 | 3.1 | Under (pigmented ink contacts paper) | Cyan only | No result - fuser offset |
| #3, Set 2 | | | | Cyan bar with transfer assist material over it | No result - fuser offset |

is improved because the transfer assist particles fill in the rough surface of the paper, allowing the toner layer to be evenly coated on its surface.

Example 5

Using the printing method described above (background and detailed description) and the apparatus as described above, the transfer assist material described as Composition 3.3 was placed in the development unit in the first position (development unit 4*a* of FIG. 5*b*). Development units in the second and third positions were filled with cyan liquid ink described as Cyan Composition 2 (development unit 4*b* of FIG. 5*b*) and magenta liquid ink described as Magenta Composition 2 (development unit 4*c* of FIG. 5*b*), respectively. In the printing process for this Example, a three bar pattern was electrostatically printed on the intermediate transfer member by the individual development units (4*a*-4*c* of FIG. 5*b*), such that the transfer assist material from the first position (development unit 4*a* of FIG. 5*b*) printed all three bars, then the first bar on the intermediate transfer member was overprinted with cyan (development unit 4*b* of FIG. 5*b*), the second was overprinted first with cyan and then with magenta (consecutive development units 4*b* and 4*c* of FIG. 5*b*), and the third was printed just with magenta (development unit 4*c* of FIG. 5*b*). Multiple prints were created in this way. The same process was repeated for a second set of prints without the use of the development unit containing the transfer assist material (4*a* of FIG. 5*b*), so that only the pigmented ink layers were applied. Both sets of prints were fused in a four roller fuser system, with the first pair of rollers set at 150° C., and the second pair set at 170° C. Although two colors were applied, as described in Example 1, the only measurements taken were for the cyan bars because the magenta and blue bars generally had fewer transfer problems and better optical densities.

Results

As shown in Table 9, below, the results for Example 5, sets 1 and 2 show that the use of this transfer assist layer formulation under the pigmented ink layers on the intermediate transfer member enhances the transferability of the toned image and the optical quality of the final image on the paper. One reason for this is that the transfer assist layer serves as a "sacrificial layer," so that any particles that do not completely transfer from the intermediate transfer member to the final paper are actually the "clear" or "inconsequential" particles, not paramount to optical quality. Additionally, the layer of transfer assist particles on the final image on the paper, when fused, can help serve as gap-fillers or can help create a glossier image, improving perceived image quality.

The results of EXAMPLES 4-5, are found in Table 9 below.

Example 6

Using the printing method described above (background and detailed description) and the apparatus as described above, the transfer assist material described as Composition 3.4 was placed in the development unit in the third position (development unit 4*c* of FIG. 5*b*). Development units in the first and second positions were filled with cyan liquid ink described as Cyan Composition 2 (development unit 4*a* of FIG. 5*b*) and magenta liquid ink described as Magenta Composition 2 (development unit 4*b* of FIG. 5*b*), respectively. In the printing process for this Example, a three bar pattern was printed, such that the first bar on the intermediate transfer member was cyan (development unit 4*a* of FIG. 5*b*), the second was printed first with cyan and then with magenta (consecutive development units 4*a* and 4*b* of FIG. 5*b*), and the third was printed just with magenta (development unit 4*b* of FIG. 5*b*). The liquid transfer assist layer (development unit 4*c* of FIG. 5*b*) was imagewise electrostatically transferred to the intermediate transfer member in a three bar pattern, over each of the three pigmented bars. Multiple prints were created in this way. The same process was repeated for a second set of prints without the use of the development unit containing the transfer assist material (4*c* of FIG. 5*b*), so that only the pigmented ink layers were applied. Both sets of prints were fused in a four roller fuser system, with the two pairs of rollers set at varying set points. The temperature for the first pair of rollers varied from 120° C.-170° C., and the set points of the second pair varied from 120° C.-190° C.

Results

As shown in Table 10, following Example 7, the results for Example 6, sets 1 and 2 show that the use of this transfer assist layer formulation over the pigmented toner on the intermediate transfer member was unsuccessful. For any given pair of fuser set points, the printed ink on the paper was offset.

Example 7

Using the printing method described above (background and detailed description) and the apparatus as described above, the transfer assist material described as Composition 3.4 was placed in the development unit in the first position (development unit 4*a* of FIG. 5*b*). Development units in the second and third positions were filled with cyan liquid ink described as Cyan Composition 2 (development unit 4*b* of FIG. 5*b*) and magenta liquid ink described as Magenta Composition 2 (development unit 4*c* of FIG. 5*b*), respectively. In

TABLE 9

| Example | Inks Used | Transfer Assist Composition | Transfer Assist Material Applied Over or Under Pigmented Ink on ITM | Color bar on paper | Measured Optical Density |
|---|---|---|---|---|---|
| #4, Set 1 | Cyan | 3.3 | Over (transfer layer | Cyan only | 1.03 |
| #4, Set 2 | composition 1 | | contacts paper) | Cyan bar with transfer assist material under it | 1.24 |
| #5, Set 1 | Cyan | 3.3 | Under (pigmented | Cyan only | 1.11 |
| #5, Set 2 | composition 1 | | ink contacts paper) | Cyan bar with transfer assist material over it | 1.14 |

the printing process for this Example, a three bar pattern was electrostatically printed on the intermediate transfer member by the individual development units (4*a*-4*c* of FIG. 5*b*), such that the transfer assist material from the first position (development unit 4*a* of FIG. 5*b*) printed all three bars, then the first bar on the intermediate transfer member was overprinted with cyan (development unit 4*b* of FIG. 5*b*), the second was overprinted first with cyan and then with magenta (consecutive development units 4*b* and 4*c* of FIG. 5*b*), and the third was printed just with magenta (development unit 4*c* of FIG. 5*b*). Multiple prints were created in this way. The same process was repeated for a second set of prints without the use of the development unit containing the transfer assist material (4*a* of FIG. 5*b*), so that only the pigmented ink layers were applied. Both sets of prints were fused in a four roller fuser system, with the first pair of rollers set at 140° C., and the second pair set at 150° C. Although two colors were applied, as described in Example 1, the only measurements taken were for the cyan bars because the magenta and blue bars generally had fewer transfer problems and better optical densities.

Results

As shown in Table 10, below, the results for Example 7, sets 1 and 2 show that the use of this transfer assist layer formulation under the pigmented ink layers on the intermediate transfer member enhances the transferability of the toned image and the optical quality of the final image on the paper. One reason for this is that the transfer assist layer serves as a "sacrificial layer," so that any particles that do not completely transfer from the intermediate transfer member to the final paper are actually the "clear" or "inconsequential" particles, not paramount to optical quality. Additionally, the layer of transfer assist particles on the final image on the paper, when fused, can help serve as gap-fillers or can help create a glossier image, improving perceived image quality.

The results of EXAMPLES 6-7, are found in Table 10 below.

TABLE 10

| Example | Inks Used | Transfer Assist Composition | Transfer Assist Material Applied Over or Under Pigmented Ink on ITM | Color bar | Measured Optical Density |
|---|---|---|---|---|---|
| #6, Set 1 | Cyan composition 1 | 3.4 | Over (transfer layer contacts paper) | Cyan only | No result - fuser offset |
| #6, Set 2 | | | | Cyan bar with transfer assist material under it | No result - fuser offset |
| #7, Set 1 | Cyan composition 1 | 3.4 | Under (pigmented ink contacts paper) | Cyan only | 1.28 |
| #7, Set 2 | | | | Cyan bar with transfer assist material over it | 1.34 |

Example 8

Using the printing method described above (background and detailed description) and the apparatus as described above, the transfer assist material described as Composition 3.2 was placed in the development unit in the third position (development unit 4*c* of FIG. 5*b*). Development units in the first and second positions were filled with cyan liquid ink described as Cyan Composition 2 (development unit 4*a* of FIG. 5*b*) and magenta liquid ink described as Magenta Composition 2 (development unit 4*b* of FIG. 5*b*), respectively. In the printing process for this Example, a three bar pattern was printed, such that the first bar on the intermediate transfer member was cyan (development unit 4*a* of FIG. 5*b*), the second was printed first with cyan and then with magenta (consequtive development units 4*a* and 4*b* of FIG. 5*b*), and the third was printed just with magenta (development unit 4*b* of FIG. 5*b*). The liquid transfer assist layer (development unit 4*c* of FIG. 5*b*) was imagewise electrostatically transferred to the intermediate transfer member in a three bar pattern, over each of the three pigmented bars. Multiple prints were created in this way. The same process was repeated for a second set of prints without the use of the development unit containing the transfer assist material (4*c* of FIG. 5*b*), so that only the pigmented ink layers were applied. Both sets of prints were fused in a four roller fuser system, with the first pair of rollers set at 140° C., and the second pair set at 150° C. Although two colors were applied, as described in Example 1, the only measurements taken were for the cyan bars because the magenta and blue bars generally had fewer transfer problems and better optical densities.

Results

As shown in Table 11, following Example 9, the results for Example 8, sets 1 and 2 show that the use of this transfer assist layer formulation over the pigmented toner on the intermediate transfer member enhances the optical quality of the final image on the paper by contacting the paper. One reason for this is that the additional, clear transfer assist layer helps to create a thicker toner layer, promoting absorption into the relatively rough areas of the paper. Another reason may be that the transfer assist layer serves to act as a sort of "glue" holding the pigmented ink layer to the paper. Optical quality is improved because the transfer assist particles fill in the rough surface of the paper, allowing the toner layer to be evenly coated on its surface.

Example 9

Using the printing method described above (background and detailed description) and the apparatus as described above, the transfer assist material described as Composition 3.2 was placed in the development unit in the first position (development unit 4*a* of FIG. 5*b*). Development units in the second and third positions were filled with cyan liquid ink described as Cyan Composition 3 (development unit 4*b* of FIG. 5*b*) and magenta liquid ink described as Magenta Composition 2 (development unit 4*c* of FIG. 5*b*), respectively. In the printing process for this Example, a three bar pattern was electrostatically printed on the intermediate transfer member by the individual development units (4*a*-4*c* of FIG. 5*b*), such that the transfer assist material from the first position (development unit 4*a* of FIG. 5*b*) printed all three bars, then the first bar on the intermediate transfer member was overprinted with cyan (development unit 4*b* of FIG. 5*b*), the second was overprinted first with cyan and then with magenta (consecutive development units 4*b* and 4*c* of FIG. 5*b*), and the third was printed just with magenta (development unit 4*c* of FIG. 5*b*). Multiple prints were created in this way. The same process was repeated for a second set of prints without the use of the development unit containing the transfer assist material (4*a* of FIG. 5*b*), so that only the pigmented ink layers were applied. Both sets of prints were fused in a four roller fuser system, with the first pair of rollers set at 100° C., and the second pair set at 150° C. Although two colors were applied, as described in Example 1, the only measurements taken were for the cyan bars because the magenta and blue bars generally had fewer transfer problems and better optical densities.

Results

As shown in Table 11, below, the results for Example 9, sets 1 and 2 show that the use of this transfer assist layer formulation under the pigmented ink layers on the intermediate transfer member enhances the transferability of the toned image and the optical quality of the final image on the paper. One reason for this is that the transfer assist layer serves as a "sacrificial layer," so that any particles that do not completely transfer from the intermediate transfer member to the final paper are actually the "clear" or "inconsequential" particles, not paramount to optical quality. Additionally, the layer of transfer assist particles on the final image on the paper, when fused, can help serve as gap-fillers or can help create a glossier image, improving perceived image quality.

The results of EXAMPLES 8-9, are found in Table 11 below.

TABLE 11

| Example | Inks Used | Transfer Assist Composition | Transfer Assist Material Applied Over or Under Pigmented Ink on ITM | Color bar on paper | Measured Optical Density |
|---|---|---|---|---|---|
| #8, Set 1 | Cyan | 3.2 | Over (transfer layer | Cyan only | 1.18 |
| #8, Set 2 | composition 1 | | contacts paper) | Cyan bar with transfer assist material under it | 1.35 |
| #9, Set 1 | Cyan | 3.2 | Under (pigmented ink | Cyan only | 1.29 |
| #9, Set 2 | composition 1 | | contacts paper) | Cyan bar with transfer assist material over it | 1.32 |

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

The invention claimed is:

1. A method of producing an image on a final image receptor from image data in a single pass electrophotographic system, comprising the steps of:

providing a photoreceptive element;

presenting the photoreceptive element to at least one toner development unit containing charged toner particles dispersed in a carrier liquid, wherein the following steps (a) through (c) are performed in a single pass of the photoreceptive element;

(a) applying a substantially uniform first electrostatic potential to the surface of the photoreceptive element;

(b) selectively discharging portions of the surface of the photoreceptive element in an imagewise manner to create a first latent image having a second electrostatic potential that is less than the absolute value of the first electrostatic potential on the surface of the photoreceptive element; and (c) exposing the surface of the photoreceptive element to the charged toner particles, wherein the charged toner particles selectively deposit on the discharged portions of the surface of the photoreceptive element to develop the first latent image and create a toned image;

providing a transfer assist material development unit containing a liquid transfer assist material comprising charged particles;

applying the transfer assist material to the toned image to form a complete image layer on the photoreceptive element, wherein the complete image layer is formed in the single pass of the photoreceptive element; and contacting the complete image layer with a final image receptor while applying an electrostatic bias potential through the final image receptor that is sufficiently strong to transfer at least a portion of the complete image layer from the photoreceptive element to the final image receptor.

2. The method of claim 1, further comprising the step of fusing at least a portion of the transferred complete image layer onto the final image receptor.

3. The method of claim 1, further comprising performing the following steps (d) through (f) at least once in the single pass of the photoreceptive element after the steps (a) through (c) are performed:

(d) applying a substantially uniform third electrostatic potential to the surface of the photoreceptive element;

(e) selectively discharging portions of the surface of the photoreceptive element in an imagewise manner to create a second latent image having a fourth electrostatic potential that is less than the absolute value of the third electrostatic potential on the surface of the photoreceptive element; and (f) exposing the surface of the photoreceptive element to a toner comprising charged toner particles, wherein the charged toner particles selectively deposit on the discharged portions of the surface of the photoreceptive element to develop the second latent image, wherein the toned image comprises the developed first and second latent images.

4. The method of claim 1, wherein the photoreceptive element is rotatable.

5. The method of claim 4, wherein the photoreceptive element comprises a photoreceptive drum.

6. The method of claim 1, wherein the charged toner particles have a glass transition temperature greater than about 35° C.

7. The method of claim 6, wherein the charged toner particles have the same polarity as the photoreceptive element.

8. The method of claim 1, wherein the transfer assist material comprises a non-pigmented liquid toner.

9. The method of claim 1, wherein the transfer assist material comprises charged particles having a glass transition temperature greater than about −10° C. and less than about 35° C.

10. The method of claim 1, wherein the transfer assist material comprises an additive to enhance durability of the image layer on the final image receptor.

11. The method of claim 1 wherein the charged particles of the transfer assist material have a volume mean particle size greater than one micron.

12. The method of claim 1, wherein the final image receptor comprises paper.

13. The method of claim 1, wherein the step of applying the transfer assist material to the toned image comprises the steps of applying a substantially uniform electrostatic potential to the surface of the toned image on the photoreceptive element, selectively discharging at least a portion of the surface of the toned image on the photoreceptive element in an imagewise manner to create a latent image, and exposing the surface of the toned image on the photoreceptive element to the charged particles of the transfer assist material, wherein charged particles of the transfer assist material selectively deposit on at least the discharged regions of the photoreceptive element on at least a portion of the toned image.

14. The method of claim 1, wherein the step of selectively discharging portions of the surface of the photoreceptive element comprises selectively exposing portions of the surface of the photoreceptive element to actinic radiation comprising one or more of ultraviolet light, visible light, and infrared light.

15. The method of claim 1, wherein the transfer assist material development unit is in contact with the photoreceptive element throughout the process of forming the complete image layer.

16. The method of claim 1, wherein each of the at least one toner development units is in contact with the photoreceptive element throughout the process of forming the toned image.

17. The method of claim 1, said contacting the complete image layer with a final image receptor comprising the steps of:

contacting the complete image layer with an intermediate transfer member having an electrostatic bias potential that is sufficiently strong to transfer at least a portion of the complete image layer from the photoreceptive element to the intermediate transfer member; and contacting at least a portion of the complete image layer with a final image receptor while applying an electrostatic bias potential through the final image receptor that is sufficiently strong to transfer at least a portion of the complete image layer from the intermediate transfer member to the final image receptor.

18. The method of claim 1, wherein the charged particles of the transfer assist material exhibit surface release characteristics.

19. The method of claim 1, wherein the transfer assist material comprises an additive to enhance adhesion of the image layer to the final image receptor.

20. A method of producing an image on a final image receptor from image data in a single pass electrophotographic system, comprising the steps of:

providing a photoreceptive element;

providing a transfer assist material development unit containing a liquid transfer assist material comprising charged particles;

applying the transfer assist material to at least a portion of the surface of the photoreceptive element;

presenting the photoreceptive element to at least one toner development unit containing charged toner particles dispersed in a carrier liquid, wherein the following steps (a) through (c) are performed in a single pass of the photoreceptive element:

(a) applying a substantially uniform first electrostatic potential to the surface of the photoreceptive element;

(b) selectively discharging portions of the surface of the photoreceptive element in an imagewise manner to create a first latent image having a second electrostatic potential that is less than the absolute value of the first electrostatic potential on the surface of the photoreceptive element; and (c) exposing the surface of the photoreceptive element to the charged toner particles, wherein the charged toner particles selectively deposit on the discharged portions of the surface of the photoreceptive element to develop the first latent image and create a toned image on at least a portion of the transfer assist material;

wherein the transfer assist material and the toned image on the photoreceptive element form a complete image layer that is formed in the single pass of the photoreceptive element; and contacting the complete image layer with a final image receptor while applying an electrostatic bias potential through the final image receptor that is sufficiently strong to transfer at least a portion of the complete image layer from the photoreceptive element to the final image receptor.

21. The method of claim 20, said contacting the complete image layer with a final image receptor comprising the steps of:

contacting the complete image layer with an intermediate transfer member having an electrostatic bias potential that is sufficiently strong to transfer at least a portion of the complete image layer from the photoreceptive element to the intermediate transfer member; and contacting at least a portion of the complete image layer with a final image receptor while applying an electrostatic bias potential through the final image receptor that is sufficiently strong to transfer at least a portion of the complete image layer from the intermediate transfer member to the final image receptor.

22. The method of claim 20, further comprising the step of fusing at least a portion of the transferred complete image layer onto the final image receptor.

23. The method of claim 20, further comprising performing the following steps (d) through (f) at least once in the single pass of the photoreceptive element after the steps (a) through (c) are performed:

(d) applying a substantially uniform third electrostatic potential to the surface of the photoreceptive element;

(e) selectively discharging portions of the surface of the photoreceptive element in an imagewise manner to create a second latent image having a fourth electrostatic potential that is less than the absolute value of the third electrostatic potential on the surface of the photoreceptive element; and (f) exposing the surface of the photoreceptive element to a toner comprising charged toner particles, wherein the charged toner particles selectively deposit on the discharged portions of the surface of the photoreceptive element to develop the second latent image, wherein the toned image comprises the developed first and second latent images.

24. The method of claim 20, wherein the photoreceptive element is rotatable.

25. The method of claim 20, wherein the photoreceptive element comprises a photoreceptive drum.

26. The method of claim 20, wherein the charged toner particles have a glass transition temperature greater than about 35° C.

27. The method of claim 26, wherein the charged toner particles have the same polarity as the photoreceptive element.

28. The method of claim 20, wherein the transfer assist material comprises a non-pigmented liquid toner.

29. The method of claim 20, wherein the charged particles of the transfer assist material exhibit surface release characteristics.

30. The method of claim 20, wherein the transfer assist material comprises an additive to enhance adhesion of the image layer to the final image receptor.

31. The method of claim 20, wherein the transfer assist material comprises charged particles having a glass transition temperature greater than about −10° C. and less than about 35° C.

32. The method of claim 20, wherein the transfer assist material comprises an additive to enhance durability of the image layer on the final image receptor.

33. The method of claim 20, wherein the charged particles of the transfer assist material have a volume mean particle size greater than one micron.

34. The method of claim 20, wherein the final image receptor comprises paper.

35. The method of claim 20, wherein the step of applying the transfer assist material to the toned image comprises the steps of applying a substantially uniform electrostatic potential to the surface of the toned image on the photoreceptive element, selectively discharging at least a portion of the surface of the toned image on the photoreceptive element in an imagewise manner to create a latent image, and exposing the surface of the toned image on the photoreceptive element to the charged particles of the transfer assist material, wherein charged particles of the transfer assist material selectively deposit on at least the discharged regions of the photoreceptive element on at least a portion of the toned image.

36. The method of claim 20, wherein the step of selectively discharging portions of the surface of the photoreceptive element comprises selectively exposing portions of the surface of the photoreceptive element to actinic radiation comprising one or more of ultraviolet light, visible light, and infrared light.

37. The method of claim 20, wherein the transfer assist material development unit is in contact with the photoreceptive element throughout the process of forming the complete image layer.

38. The method of claim 20, wherein each of the at least one toner development units is in contact with the photoreceptive element throughout the process of forming the toned image.

39. A method of producing an image on a final image receptor from image data in a single pass electrophotographic system, comprising the steps of:

providing a photoreceptive element;

presenting the photoreceptive element to at least one toner development unit containing charged toner particles dispersed in a carrier liquid, wherein the following steps (a) through (c) are performed in a single pass of the photoreceptive element;

(a) applying a substantially uniform first electrostatic potential to the surface of the photoreceptive element;

(b) selectively discharging portions of the surface of the photoreceptive element in an imagewise manner to create a first latent image having a second electrostatic potential that is less than the absolute value of the first electrostatic potential on the surface of the photoreceptive element; and (c) exposing the surface of the photoreceptive element to the toner comprising charged toner particles, wherein the charged toner particles selectively deposit on the discharged portions of the surface of the photoreceptive element to develop the first latent image and create a toned image;

forming a complete image layer from the toned image on an intermediate transfer member by using a transfer assist material development unit containing a liquid transfer assist material comprising charged particles dispersed in a carrier liquid; and contacting the complete image layer with a final image receptor while applying an electrostatic bias potential through the final image receptor that is sufficiently strong to transfer at least a portion of the complete image layer from the intermediate transfer member to the final image receptor.

40. The method of claim 39, further comprising the step of fusing at least a portion of the transferred complete image layer onto the final image receptor.

41. The method of claim 39, further comprising performing the following steps (d) through (f) at least once in the single pass of the photoreceptive element after the steps (a) through (c) are performed:

(d) applying a substantially uniform third electrostatic potential to the surface of the photoreceptive element;

(e) selectively discharging portions of the surface of the photoreceptive element in an imagewise manner to create a second latent image having a fourth electrostatic potential that is less than the absolute value of the third electrostatic potential on the surface of the photoreceptive element; and (f) exposing the surface of the photoreceptive element to a toner comprising charged toner particles, wherein the charged toner particles selectively deposit on the discharged portions of the surface of the photoreceptive element to develop the second latent image, wherein the toned image comprises the developed first and second latent images.

42. The method of claim 39, wherein the photoreceptive element is rotatable.

43. The method of claim 42, wherein the photoreceptive element comprises a photoreceptive drum.

44. The method of claim 39, wherein the charged particles of the toner have a glass transition temperature greater than about 35° C.

45. The method of claim 39, wherein the charged toner particles have the same polarity as the photoreceptive element.

46. The method of claim 39, wherein the transfer assist material comprises a non-pigmented liquid toner.

47. The method of claim 39, wherein the transfer assist material comprises an additive to enhance adhesion of the image layer to the final image receptor.

48. The method of claim 39, wherein the transfer assist material comprises an additive to enhance durability of the image layer on the final image receptor.

49. The method of claim 39, wherein the charged particles of the transfer assist material have a glass transition temperature greater than about −10° C. and less than about 35° C.

50. The method of claim 39, wherein the final image receptor comprises paper.

51. The method of claim 39, wherein the step of applying the transfer assist material to at least a portion of the toned image comprises the steps of biasing the surface of the intermediate transfer member and electrostatically transferring the charged transfer assist material to at least a portion of the intermediate transfer member on at least a portion of the toned image.

52. The method of claim 39, wherein the step of selectively discharging portions of the surface of the photoreceptive element comprises selectively exposing portions of the surface of the photoreceptive element to actinic radiation comprising one or more of ultraviolet light, visible light, and infrared light.

53. The method of claim 39, wherein the transfer assist material development unit is in contact with the photoreceptive element throughout the process of forming the complete image layer.

54. The method of claim 39, wherein each of the at least one toner development units is in contact with the photoreceptive element throughout the process of forming the toned image.

55. The method of claim 39, wherein the intermediate transfer member is rotatable.

56. The method of claim 55, wherein the intermediate transfer member comprises a drum.

57. The method of claim 39, said forming a complete image layer from the toned image comprising the steps of:

contacting the toned image with the intermediate transfer member wherein the intermediate transfer member comprises an electrostatic bias potential that is sufficiently strong to transfer at least a portion of the toned image from the photoreceptive element to the intermediate transfer member;

providing a transfer assist material development unit containing a liquid transfer assist material comprising charged particles dispersed in a carrier liquid; and applying the transfer assist material to at least a portion of the toned image to form a complete image layer on the intermediate transfer member, wherein the complete image layer is formed in the single pass of the photoreceptive element.

58. The method of claim 39, said forming a complete image layer from the toned image comprising the steps of:

providing a transfer assist material development unit containing a liquid transfer assist material comprising charged particles;

applying the transfer assist material to at least a portion of the surface of the intermediate transfer member; and contacting the toned image with the intermediate transfer member while applying an electrostatic bias potential through the intermediate transfer member that is sufficiently strong to transfer at least a portion of the toned image from the photoreceptive element to the intermediate transfer member to form a complete image layer, wherein at least a portion of the toned image is positioned on at least a portion of the transfer assist material on the intermediate transfer member, and wherein the complete image layer is formed in the single pass of the photoreceptive element.

59. The method of claim 39, wherein the charged particles of the transfer assist material exhibit surface release characteristics.

* * * * *